US008398839B1

(12) United States Patent
Morales et al.

(10) Patent No.: US 8,398,839 B1
(45) Date of Patent: Mar. 19, 2013

(54) SYSTEM FOR PARTICLE CONCENTRATION AND DETECTION

(75) Inventors: Alfredo M. Morales, Livermore, CA (US); Josh A. Whaley, Livermore, CA (US); Mark D. Zimmerman, Livermore, CA (US); Ronald F. Renzi, Tracy, CA (US); Huu M. Tran, San Jose, CA (US); Scott M. Maurer, Haymarket, VA (US); William D. Munslow, Gainesville, VA (US)

(73) Assignee: Sandia Corporation, Albuquerque, NM (US)

( * ) Notice: Subject to any disclaimer, the term of this patent is extended or adjusted under 35 U.S.C. 154(b) by 308 days.

(21) Appl. No.: 12/793,370

(22) Filed: Jun. 3, 2010

Related U.S. Application Data

(60) Provisional application No. 61/184,334, filed on Jun. 5, 2009.

(51) Int. Cl.
*B03C 5/02* (2006.01)

(52) U.S. Cl. ..... 204/547

(58) Field of Classification Search ..... 204/547
See application file for complete search history.

(56) References Cited

U.S. PATENT DOCUMENTS

| | | | | |
|---|---|---|---|---|
| 6,998,598 | B2 * | 2/2006 | Horn et al. | 250/216 |
| 2003/0057094 | A1 * | 3/2003 | Bryning et al. | 204/547 |
| 2004/0211669 | A1 * | 10/2004 | Cummings et al. | 204/547 |
| 2008/0105565 | A1 * | 5/2008 | Davalos et al. | 205/775 |

OTHER PUBLICATIONS

Sabounchi et al. Biomed. Microdevices (2008) 10:661-670.*
Principals of Instrumental Analysis Fourth Edition, Skoog and Leery Eds.*
Davalos et al. Anal. Bioanal. Chem (2008) 390:847-855.*
"Pluronice® F-127" Data Sheet.*
Technology Information Summary published by the EPA.*

* cited by examiner

*Primary Examiner* — Luan Van
*Assistant Examiner* — Steven Rosenwald
(74) *Attorney, Agent, or Firm* — Timothy P. Evans

(57) ABSTRACT

A new microfluidic system comprising an automated prototype insulator-based dielectrophoresis (iDEP) triggering microfluidic device for pathogen monitoring that can eventually be run outside the laboratory in a real world environment has been used to demonstrate the feasibility of automated trapping and detection of particles. The system broadly comprised an aerosol collector for collecting air-borne particles, an iDEP chip within which to temporarily trap the collected particles and a laser and fluorescence detector with which to induce a fluorescence signal and detect a change in that signal as particles are trapped within the iDEP chip.

29 Claims, 23 Drawing Sheets collector.vi

File Edit View Project Operate Tools Window Help

BioXC 200GX

BioXC 200GX Parameters

| Variable | Value | Description |
|---|---|---|
| d | 40 | Pump 1 Clean Cycle On Time |
| rc | 15 | Rotating Impaction Arm Cleaning time |
| p2c | 120 | Pump 2 Clean Cycle On Time |
| d | 0 | |
| pt | 0 | |
| r | 90 | Pump 2 On Time to Empty Sample from Vial |
| a | 0 | |
| p1 | 60 | Dry Collection Time |
| p2 | 0 | |
| p2a | 0 | |
| cd | 60 | Sample Extraction Time |
| ps | 5 | |
| rs | 13200 | |
| pd | 2 | Collection Pulse Delay. Time rotating impactor is off during wet collection. |
| pw | 1 | Collection Pulse Width. Time rotating impactor is on during wet collection. |
| s | 80 | Total Cycle Time of Sample Collection |

Return

*FIG. 6D*

SYSTEM FOR PARTICLE CONCENTRATION AND DETECTION

CROSS-REFERENCE TO RELATED APPLICATION

This application claims priority to prior U.S. Provisional Patent Application Ser. No. 61/184,334 originally filed Jun. 5, 2009 entitled "System for Particle Concentration and Detection" from which benefit is claimed.

STATEMENT OF GOVERNMENT INTEREST

The United States Government has a paid-up license in this invention and the right in limited circumstances to require the patent owner to license others on reasonable terms as provided for by the terms of contract No. DE-AC04-94AL85000 awarded by the U.S. Department of Energy to Sandia Corporation.

BACKGROUND

Technical Problem

There is a need for a low cost, fast response, low detection limit, low false alarm rate, bio-aerosol early warning system for use in governmental and commercial infrastructure protection initiatives. Unfortunately, current individual technological approaches to bio-detection often must make tradeoffs among cost, speed of response, sensitivity, and accuracy. For instance, the "gold standard" for pathogen identification, the polymerase chain reaction (PCR) bioassay, is very accurate but requires expensive biochemicals. On the other hand, low-cost-to-operate aerosol sample collectors coupled with real-time, non-selective light scattering detectors yield an unacceptable number of false alarms.

A potentially revolutionary solution to this problem is the coupling, or integration, of two or more, low cost, orthogonal sensor triggers together with a very accurate bioassay. One example of such a sensor trigger are fast aerosol light scattering detectors. By themselves, light scattering detectors produce many false positive signals. However, when coupled to a second, orthogonal trigger, the likelihood that the two sensors produce false positive signals at the same time is acceptably small. Furthermore, since the bioassay need be run only in those occasions when the multiple orthogonal sensor triggers produce a positive signal, the costs to operate the systems are greatly reduced while maintaining a high degree of accuracy. Moreover, additional reductions in cost may be achieved by miniaturizing the triggering and bioassay devices such that smaller amounts of reagents are consumed together with a corresponding reduction in waste produced waste. A large, laboratory-based research effort based on microfluidic insulator-based dielectrophoresis (iDEP) at our facilities over the past 7 years has shown that iDEP is capable of trapping and differentiating different types of bioparticles (live vs. dead bacteria; spores vs. vegetative cells) under low flow conditions. We have applied this experience to the development and laboratory testing of a prototype iDEP triggering device.

To accomplish our objective, we have applied experience in developing microfluidics and iDEP technology at our facilities and described and disclosed in U.S. Pat. Nos. 7,347,923, 7,204,923, and 7,014,747, herein incorporated by reference in their entirety. Additionally, iDEP technology is further disclosed by Lapizco-Encinas et al. in "Dielectrophoretic concentration and separation of live and dead bacteria in an array of insulators," *Analytical Chemistry,* 2004, v. 76(6): pp. 1571-1579; in "Insulator-based dielectrophoresis for the selective concentration and separation of live bacteria in water," Electrophoresis, 2004, v. 25(10-11): p. 1695-1704; and in "An insulator-based (electrodeless) dielectrophoretic concentrator for microbes in water," *Journal of Microbiological Methods,* 2005, v. 62(3), SI, pp. 317-326; and by Simmons et al., in "Polymeric insulator-based (electrodeless) dielectrophoresis (iDEP) for the monitoring of water-borne pathogen," *Royal Society of Chemistry, Special Publications,* 2005, iss. 297; pp. 171-173; by Davalos et al. in "Performance impact of dynamic surface coatings on polymeric insulator-based dielectrophoretic particle separators," *Analytical and Bioanalytical Chemistry,* 2008, v. 390(3): pp. 847-855; and by Sabounchi et al. in "Sample concentration and impedance detection on a microfluidic polymer chip," *Biomedical Microdevices,* 2008, v. 10(5): pp. 661-670, all herein incorporated by reference. Ancillary microfluidic components (valves, fittings, pumps, etc) and the high flow plastic microfluidic devices needed for this project were also previously developed at our facilities.

SUMMARY

The present system comprises a "smart" system for unattended particle collection capability that would include the capability to autonomously trigger a subsequent analysis for microchemical/biological species. The device further includes a compact, efficient aqueous sample collector; an insulator-based dielectrophoretic (iDEP) device for particle concentration and trapping, and a laser induced fluorescence detection device to trigger an electronic response in the device to direct the instrument to begin a more detailed analysis of the trapped particles using a complimentary microanalysis system for fast, accurate presumptive identification. Also included is a sample cleanup capability to flush the microfluidic chip of collected debris and thereby provide for re-use of the chip.

This device will classify particles collected from the surrounding atmosphere by first screening the particles to accept only those within a specific size range of diameters and secondly by accepting only those particles that have been trapped in dielectrophoretic fields having specific predetermined voltage potentials such that the device triggers the use of a downstream bio-identification assay. Should this instrument trigger not signal a "positive" result, no further analysis is performed.

BRIEF DESCRIPTION OF THE DRAWINGS

The accompanying drawings illustrate one or more embodiments of the present invention and, which together with the description, form a part of the specification and serve to explain the principles of the invention. These drawings are only for the purpose of illustrating one or more preferred embodiments of the invention and are not to be construed as limiting the invention. In the drawings:

FIG. 6D illustrates a separate screen to create a program to run the BIOXC™ 200GX aerosol collector, wherein the aerosol collector program can then be called from inside a preprogrammed command sequence or from the manual mode control screen.

DETAILED DESCRIPTION OF EMBODIMENT OF THE INVENTION

In iDEP systems of our design, electrodes located outside the microfluidic chip apply an electric field across the main fluidic channel. Insulating posts and other features in the chip cause non-uniformities in the electric field and any particle traveling in a fluid inside the chip experiences dielectrophoretic forces and these forces can be used to trap, concentrate, and separate particles such as spores, cells, or viruses under low flow conditions.

The present system comprises the following subsystems:

Fluidics: to transport fluid from an aerosol sample collector, through the iDEP chip, through the detector, and out to the waste bottle. The fluidic system also allows the introduction of particles from a separate sample vial into the fluid that comes out of the aerosol sample collector.

Electronics: to control and monitor the aerosol sample collector, valves, pumps, particle detector, and pressure sensors.

Control software: to input the operating parameters for either a manual run or a fully automated run.

Particle detector: for providing an indication of whether or not particles have been trapped by the iDEP chip.

Packaging: an enclosure to protect the instrument that allows for air to be processed by the aerosol sample collector.

Each of these subsystems is now described in more detail below.

Figure 1:
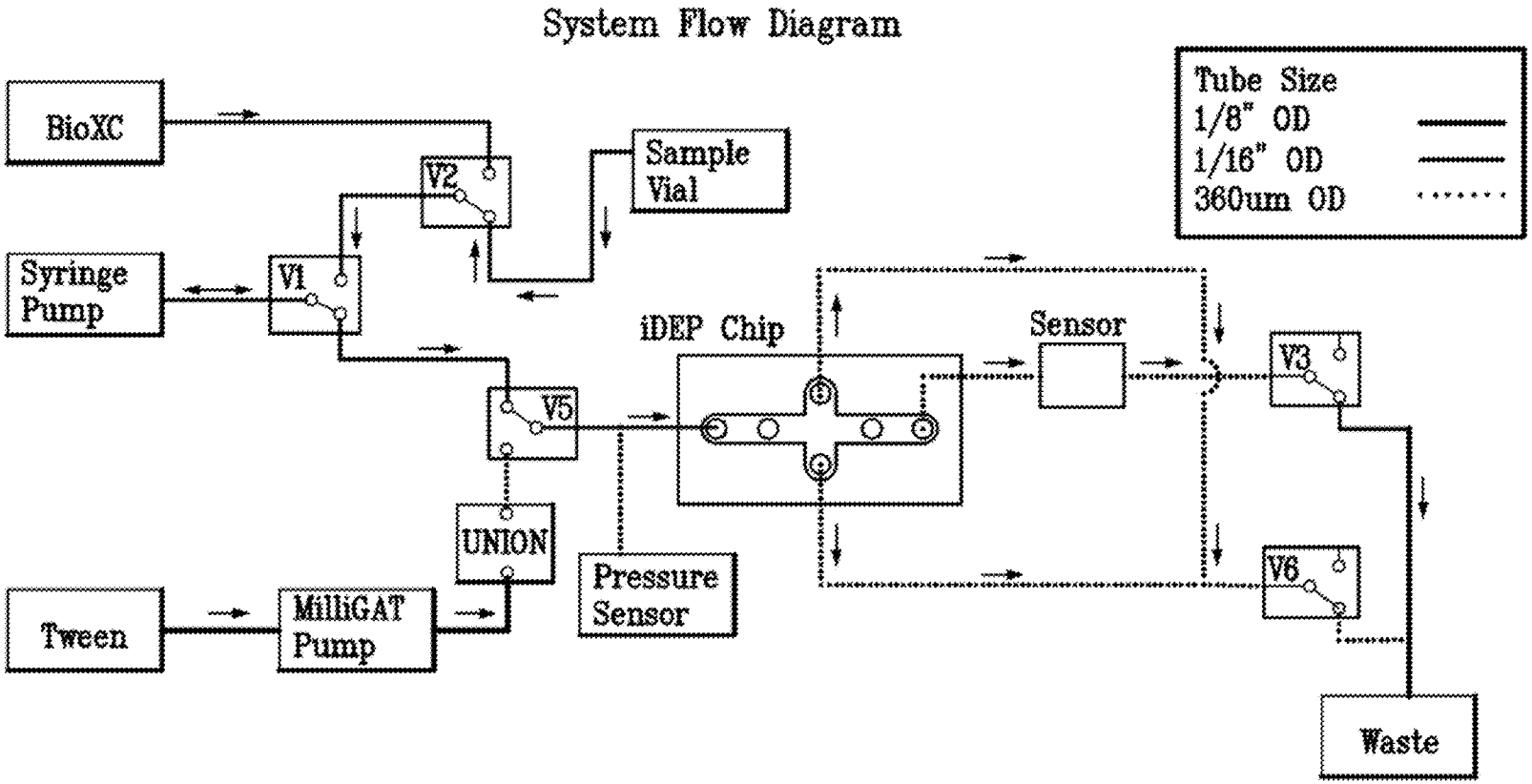
FIG. 1 illustrates a fluidic flow schematic of the iDEP system of the present invention. The syringe pump uses two 3-way valves to alternatingly withdraw an air sample or a microbead internal calibration solution for subsequent pumping into the rest of the iDEP system.
Figure 2:
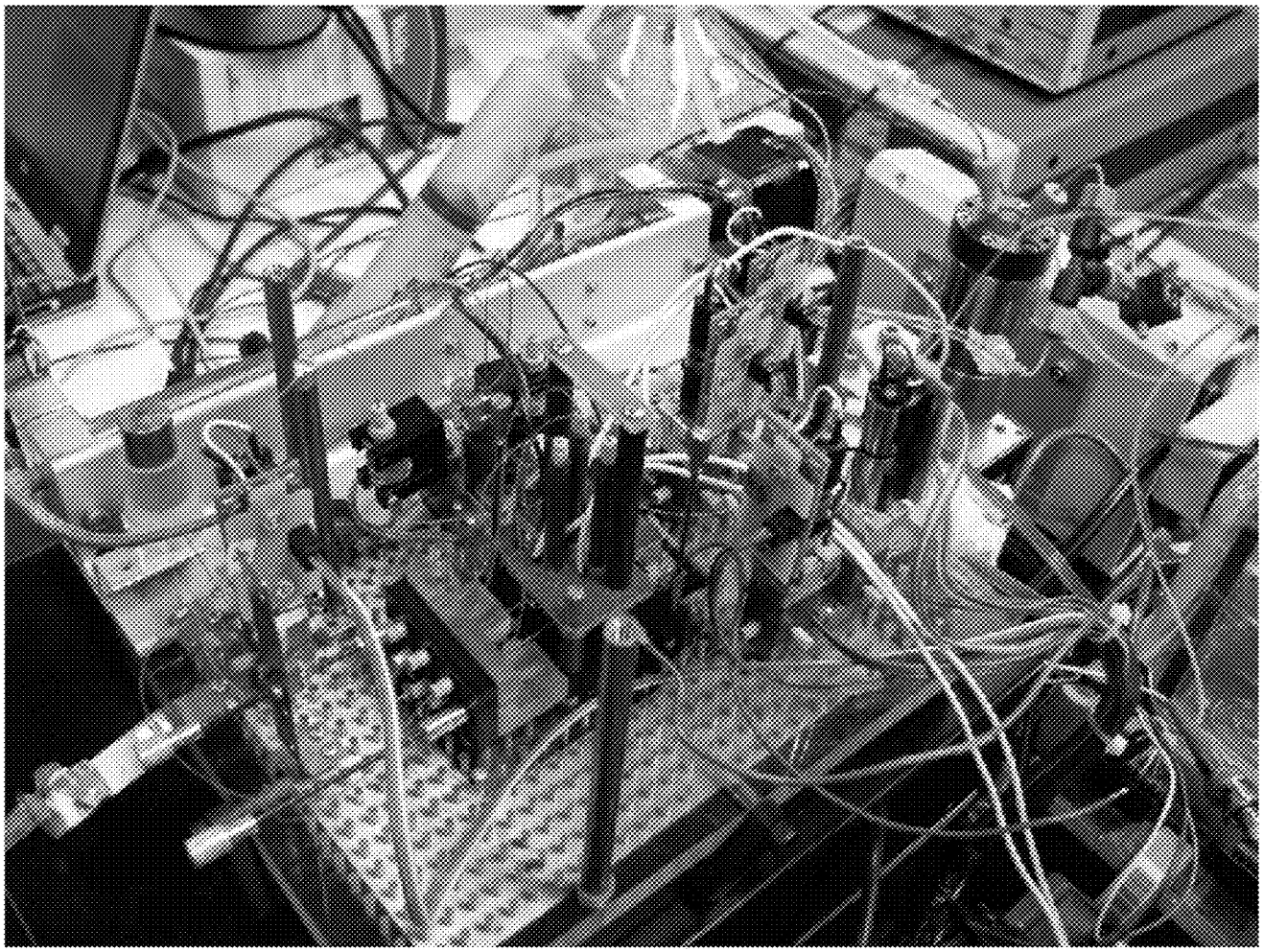
FIG. 2 illustrates the original lab-based chip holder.
Figure 3A:
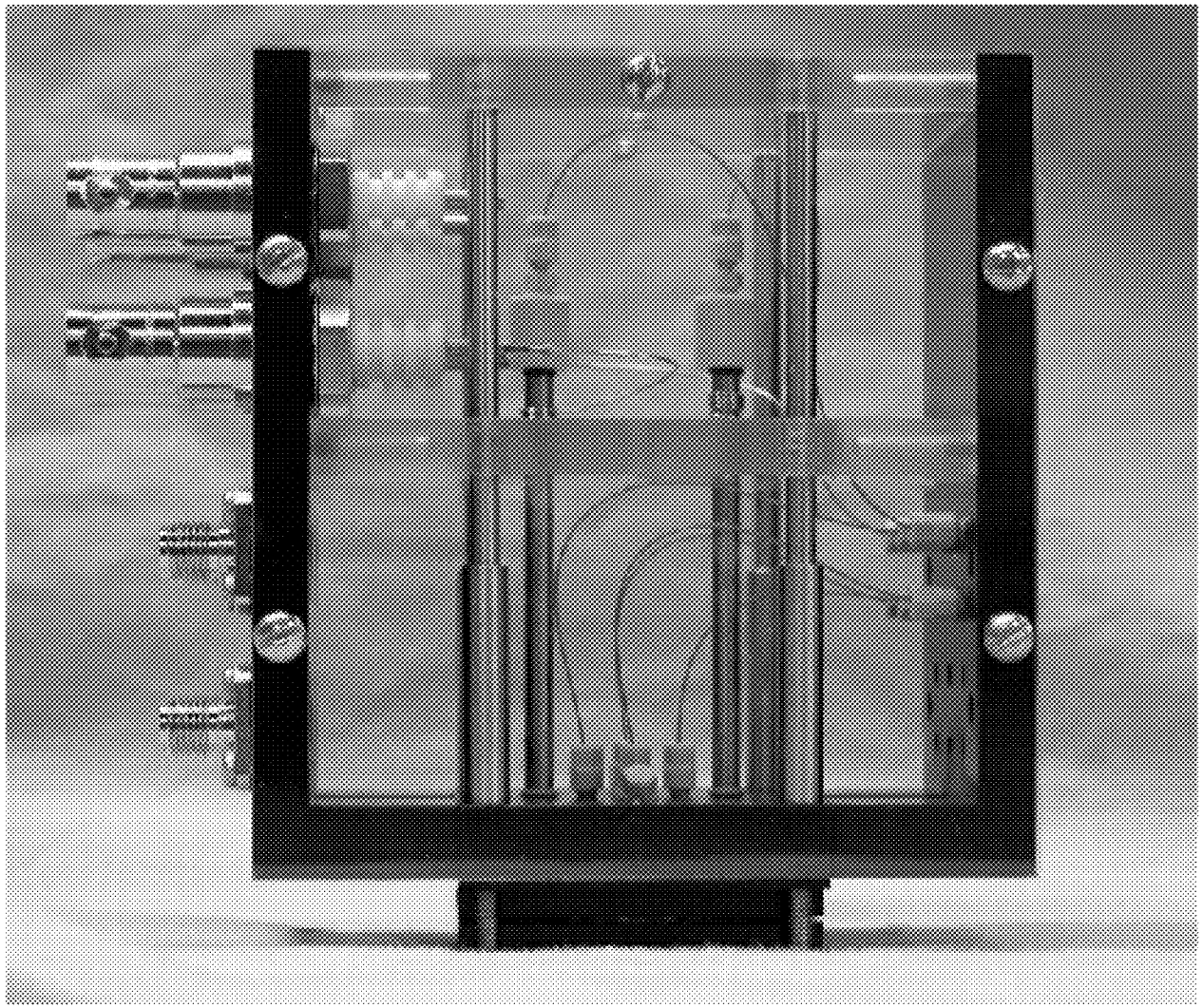
FIG. 3A illustrates a side view of a redesigned chip holder.
Figure 3B:
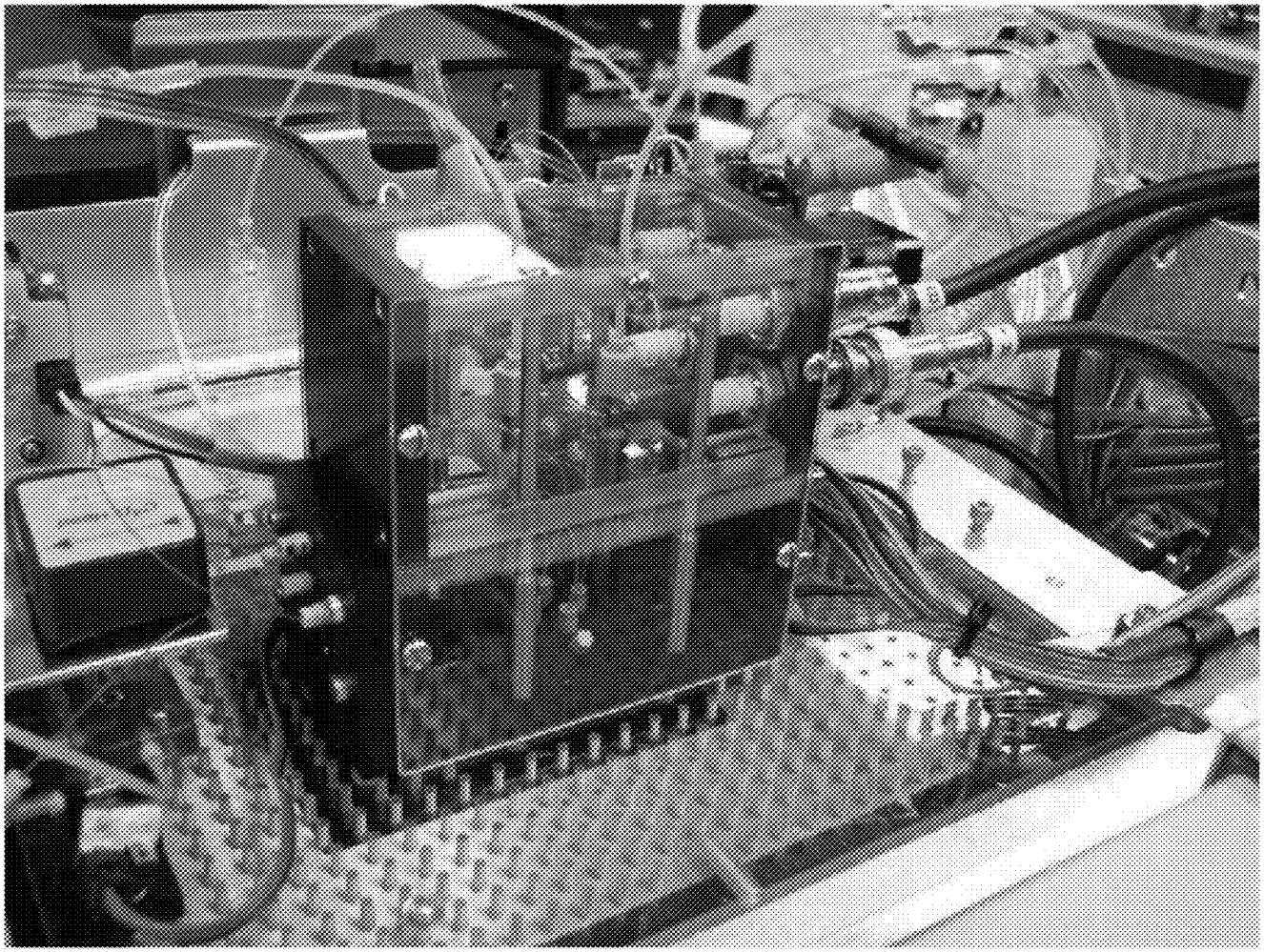
FIG. 3B illustrates the redesigned chip holder mounted on system breadboard.
Figure 4A:
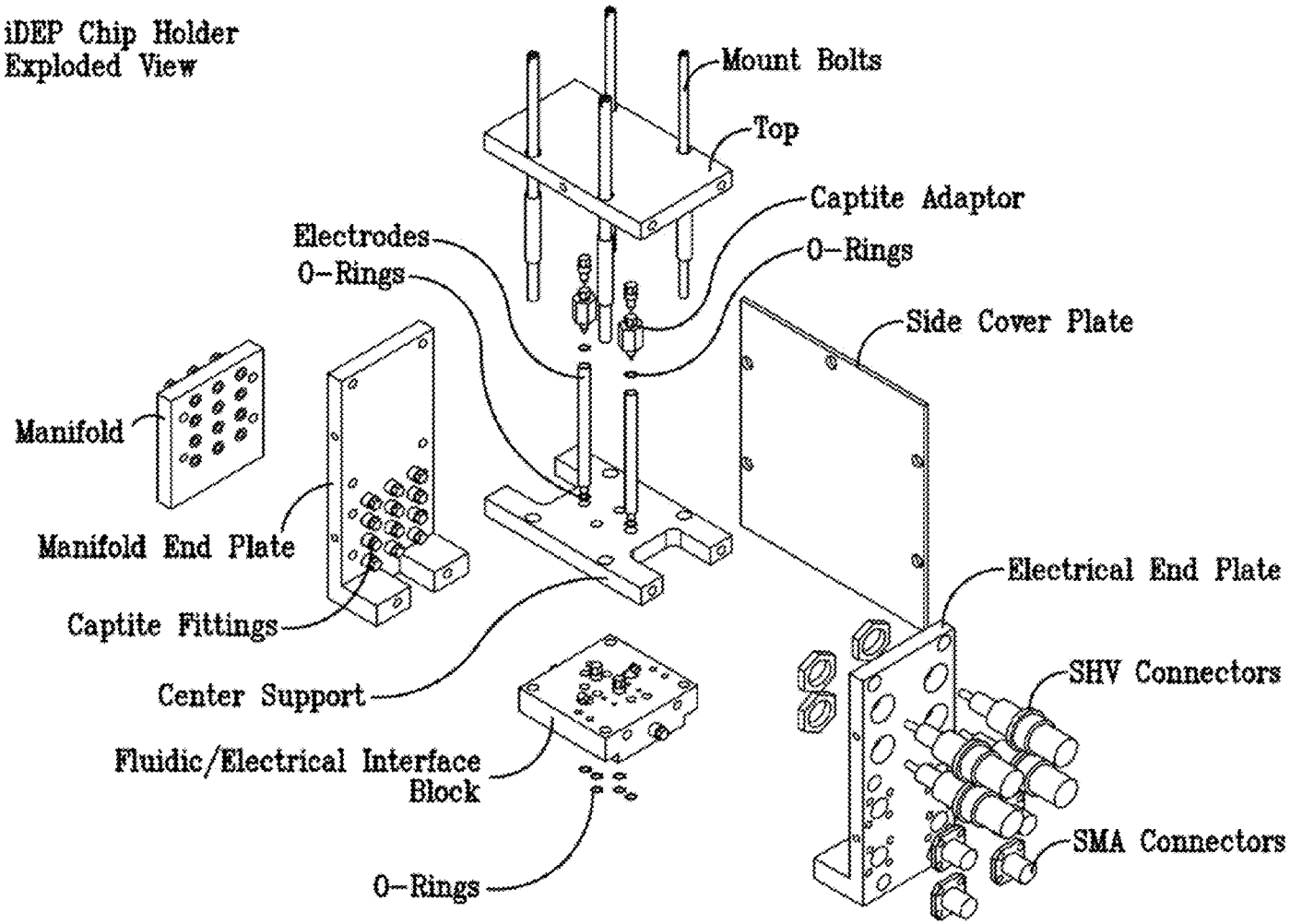
FIG. 4A shows the exploded schematic view of the redesigned chip holder.
Figure 4B:
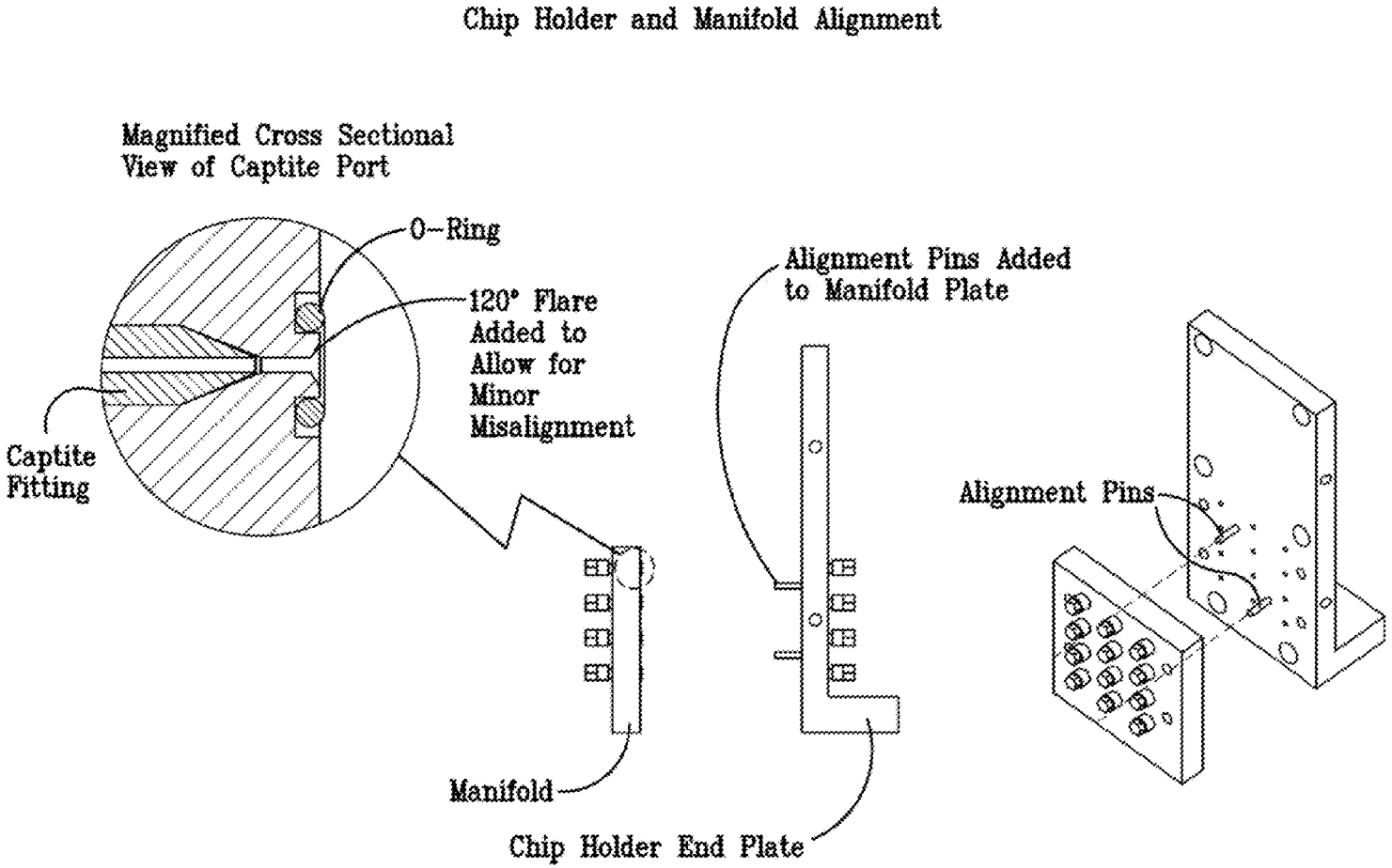
FIG. 4B shows various schematic views of the redesigned chip holder with the addition of alignment pins to the chip holder/manifold interface.

Fluidics:

FIG. 1 shows a schematic of fluidic flow in the present system. The fluidic architecture incorporates several key modifications that allow the system to operate safely and efficiently. The lab-based chip holder is shown in FIG. 2 and is seen to comprise a structure adapted for experimental purposes and not one optimized for use in the intended urban environment. The new holder is shown in FIGS. 3A and 3B and an exploded, schematic view of the new holder is shown in FIG. 4A while FIG. 4B shows details of the chip holder attachment interface. The new chip holder assembly was built to provide easy removal of the entire chip holder from the fluidic system and to facilitate removal of the chip from the chip holder. The holder also protects the fragile capillary tubing and connections from excessive handling, shields the user from the high voltage terminals, and allows quick disconnect of the electrical signals. The layout of the valves was changed in an effort to minimize the number of connections and length of tubing in the fluidic circuit.

An important lesson learned during development of the iDEP system was that since the system was used to trap and manipulate particles, clogging of the tubes carrying particle suspension in and out of the iDEP chip by the particles was an issue. It was eventually decided that very small capillary tubing (e.g. plastic capillary tubing that is 360 μm outside diameter (O.D.), 175 μm inside diameter (I.D.) should only be used in an iDEP system when it was absolutely necessary to minimize both time to travel a certain length and particle dispersion. Thus FIG. 1 shows that 1/16" O.D. tubing with 750 μm I.D. was used to bring particles from either the aerosol collector or a separate sample vial into the iDEP chip. 360 μm O.D. plastic capillary was used to connect the outlet of the iDEP chip to the off-chip detector because in this leg of the microfluidic circuit it was desired to minimize the time it took for the particles to flow from the chip to the detector and because the smaller I.D. reduced particle dispersion. Furthermore, misalignment of the chip holder assembly and the fluidic manifold plate frequently resulted in restricted flow. The observed misalignment was minimized by adding alignment pins to the chip holder/manifold coupling shown in FIG. 4B.

As shown in FIG. 1, an experiment will start by collecting an air sample using a BIOXC™ 200GX aerosol collector (available from ICX Mesosystems, Albuquerque, N. Mex.). The BIOXC™ 200GX is configured to pull through several liters of ambient air and deposit particles found in the air that are within a size range that can enter human lungs during respiration (about 0.5 μm to about 10 μm) into a preset volume of water (typically a one milliliter (mL) volume). The water used to collect the particles is de-ionized water mixed with 0.001% to 0.01% v/v TWEEN, a non-ionic surfactant that helps prevent fouling of the aerosol collector surfaces. The fluidic system would then use a syringe pump to withdraw the water sample from the aerosol collector and inject it into the inlet electrode of the chip holder. An alternate fluidic path was added to the system to allow for the wet introduction of particles from a sample vial into the liquid coming out of the aerosol collector. This alternate fluidic path allows "spiking" of an aerosol sample without aerosolizing the spiking particles, a system feature needed to conduct tests at sites where aerosolizing particles is not allowed. During laboratory tests, the particles being trapped are withdrawn with the syringe pump from the sample vial and are then injected into the inlet electrode.

Figure 5:
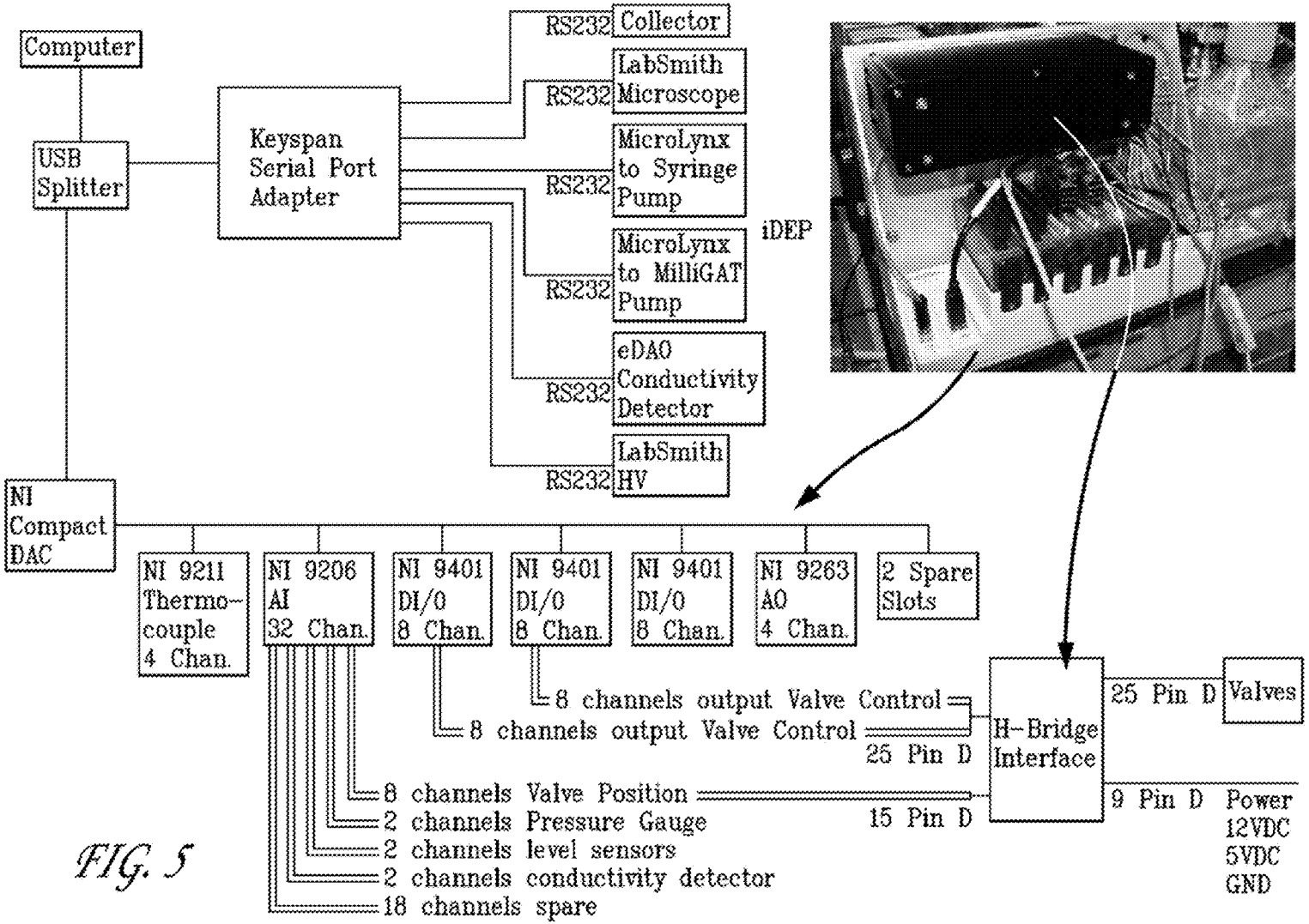
FIG. 5 shows the system control and data acquisition system diagram.
Figure 6A:
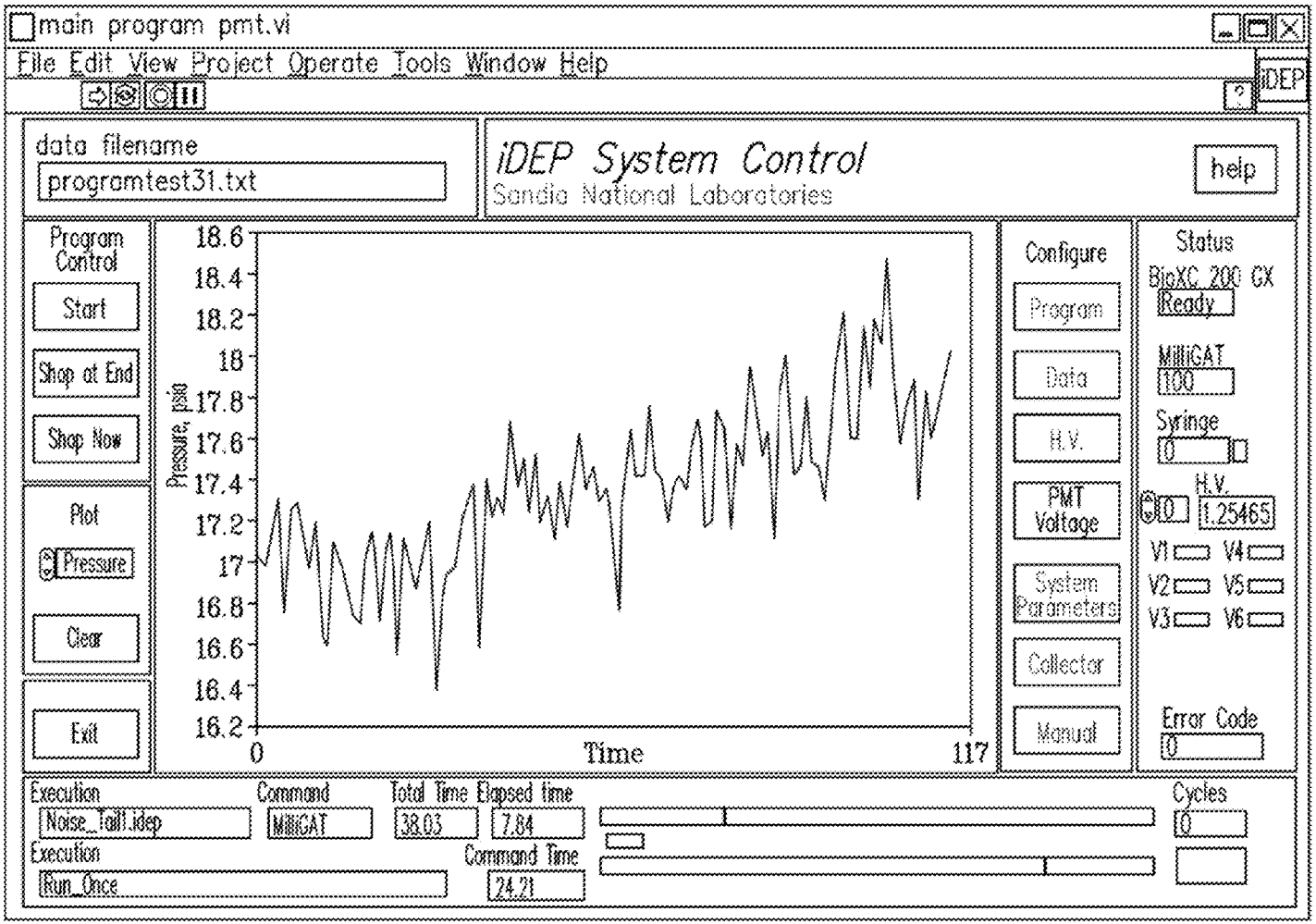
FIG. 6A illustrates a main control screen of a computer interface running new software providing a user with the ability to run preprogrammed command sequences.
Figure 6B:
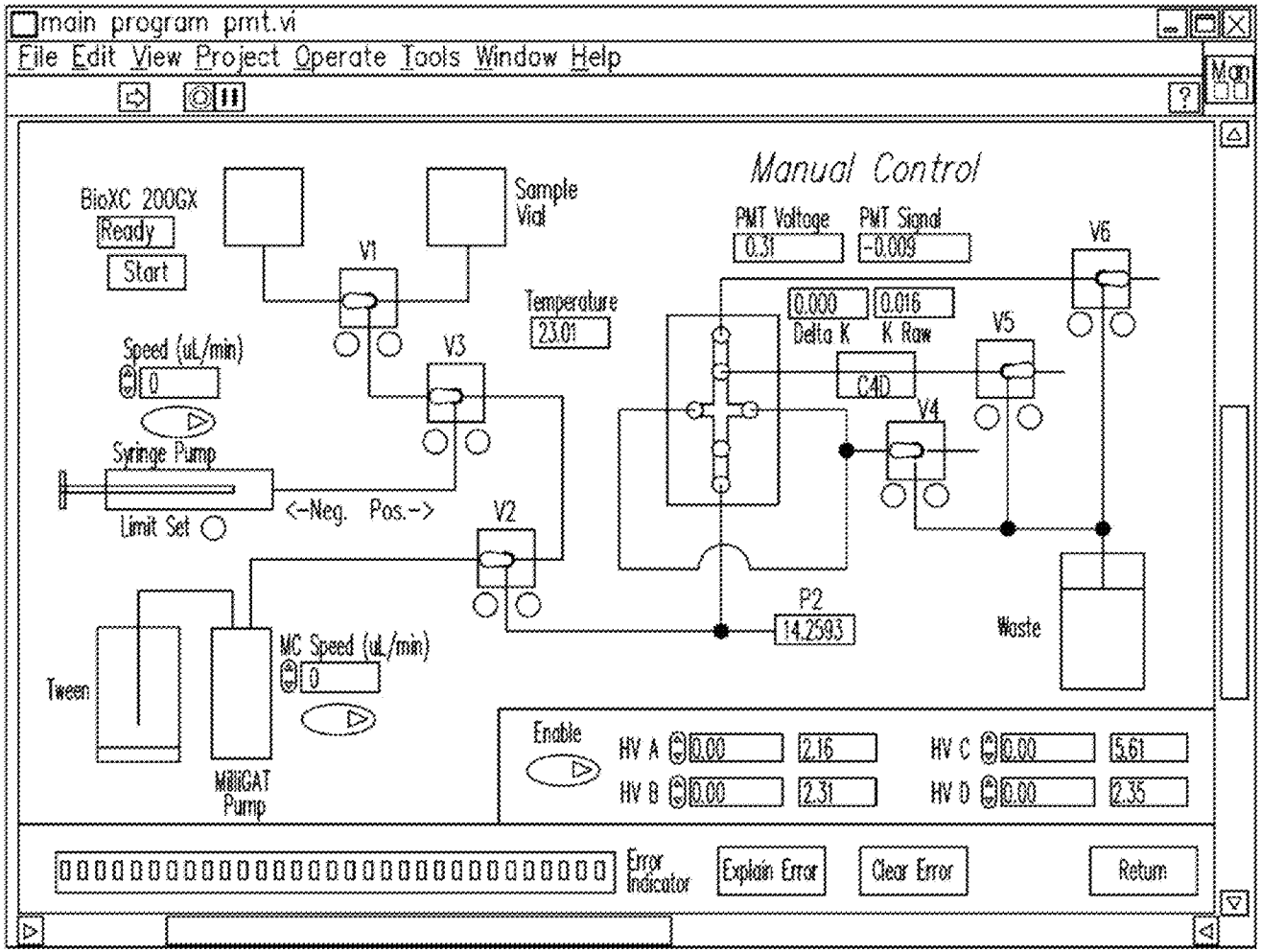
FIG. 6B illustrates an interactive control screen and microfluidic menu that allows the user to actuate individual components manually.
Figure 6C:
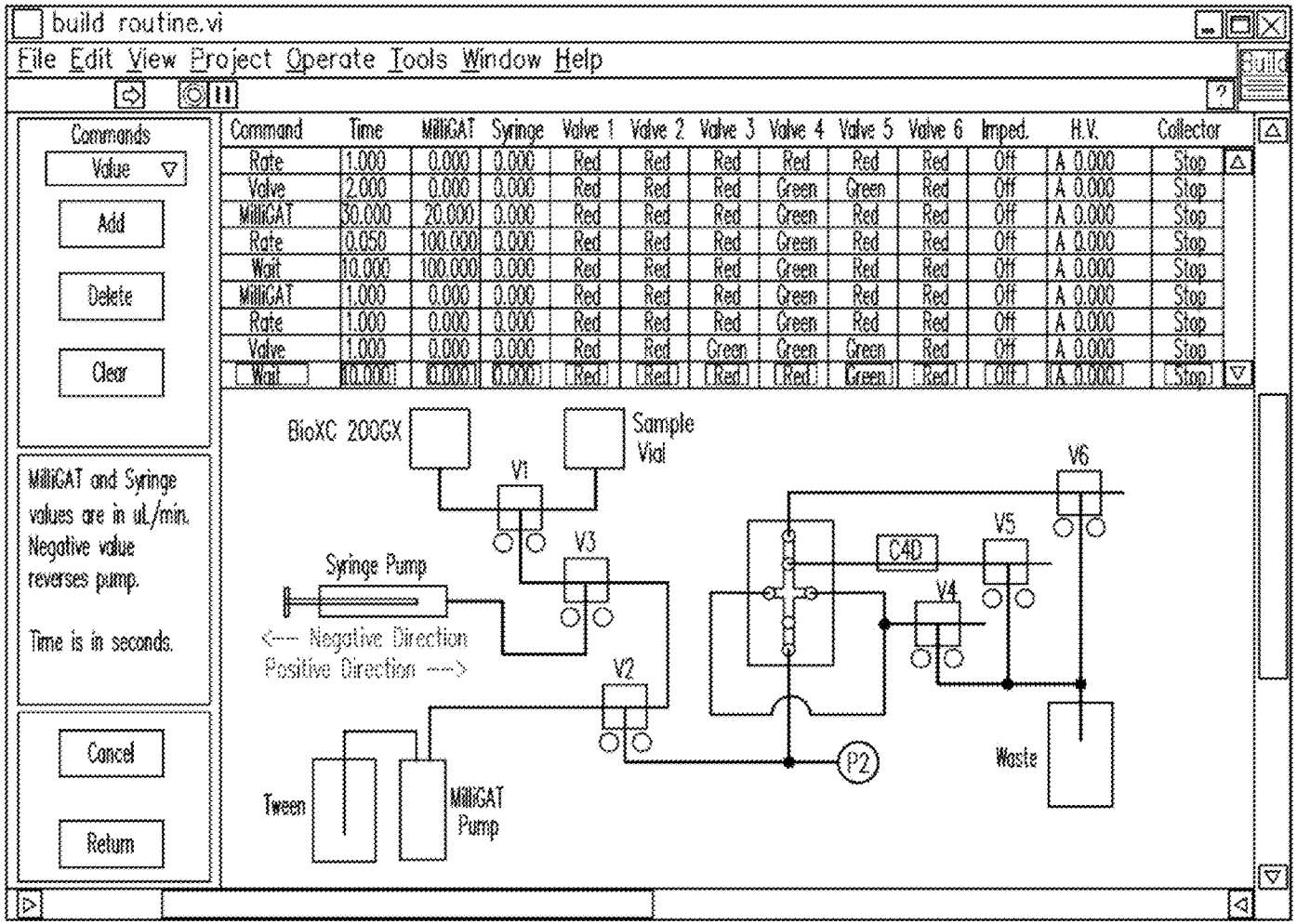
FIG. 6C illustrates an intuitive control screen to create preprogrammed command sequences.

Electronics:

A commercial USB capable compact DAQ (cDAQ) system (obtained from National Instruments Corporation, Austin, Tex.) was used as the main data collection and control interface. This modular system allowed specific modules to be easily installed and configured through LABVIEW®. The cDAQ performs all of the required digital input and output functions, as well as 16 bit analog I/O. The digital output is capable of controlling eight 3-way fluidic valves. Valve control requires that a custom interface box be made, which incorporates H-bridge driver circuitry, i.e., an electronic circuit which enables a voltage to be applied across a load in either direction. These circuits are often used to operate a DC motor in both the forwards and backwards direction. Analog signal feedback provides valve status. In addition, the cDAQ monitors sensors and control system components. A control diagram of the system is shown in FIG. 5. A USB to serial expander unit was installed to communicate with the pump controllers, high voltage power supply, video microscope, cDAQ conductivity detector, and the BIOXC™ 200GX aerosol sample collector. Two commercial DC power supplies were installed to supply the required power for all components and minimize the footprint by eliminating multiple redundant units.

Control Software:

A new LABVIEW®-based control software for the National Instruments cDAQ system described above was created and is illustrated in representative screen shots shown in FIGS. 6A-6D. The new control software allows the user to manually control all aspects of the system and to run user written programs to execute specific control sequences. During a programmed control sequence, twenty-six channels of data are collected at a rate of up to 30 Hertz and saved to a file for later processing. A laptop computer is used for hardware control and connects to the system via a single USB cable.

Particle Detector:

Four different particle detector types were evaluated.

Figure 7A:
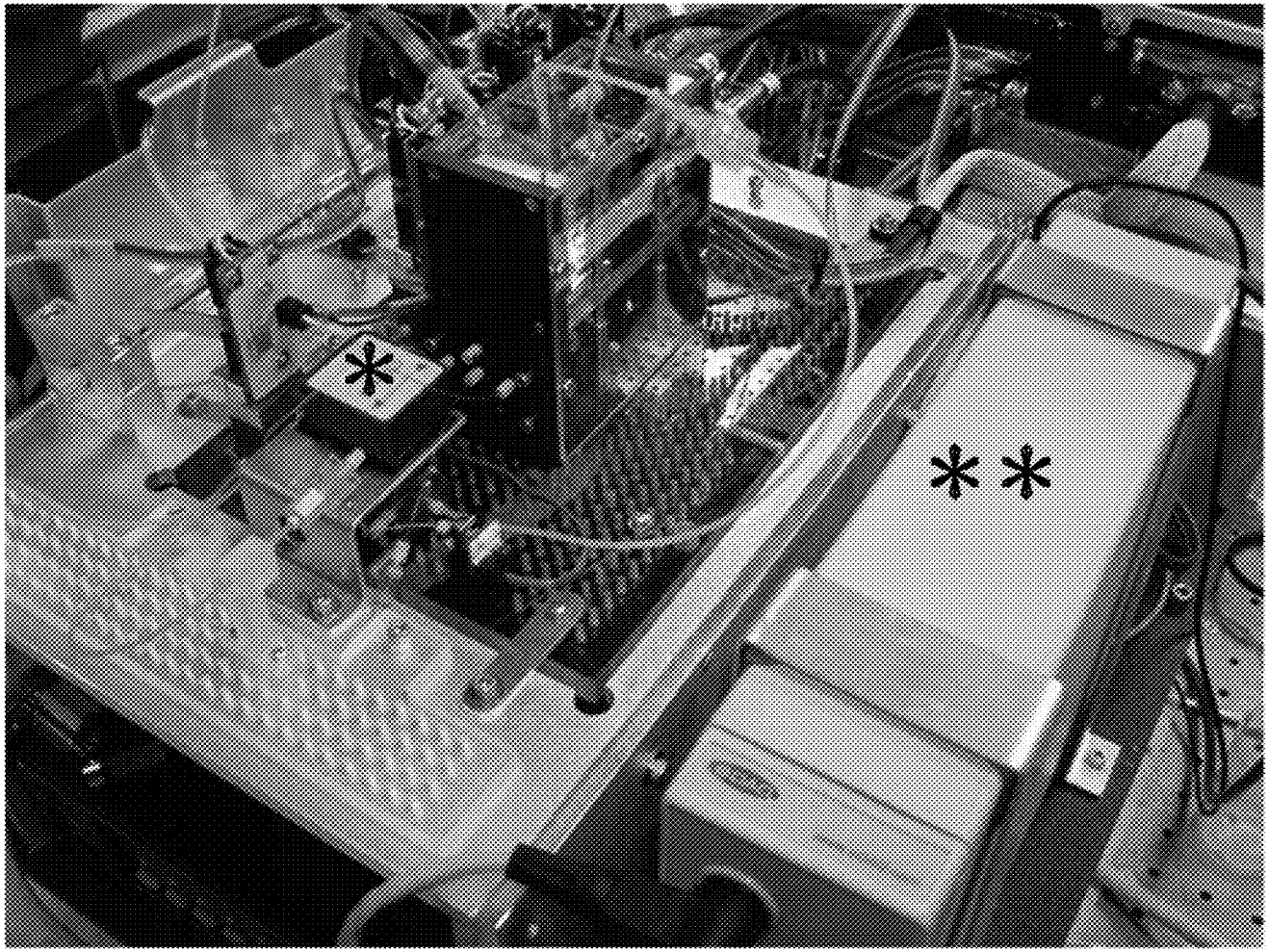
FIG. 7A illustrates a capillary based impedance detector head unit (*) and its associated electronics (#).

Capillary based impedance detector: This was carried out using a Capacitively Coupled Contactless Conductivity Detection instrument (C4D, manufactured by eDAQ, Australia, www.eDAQ.com). In the C4D instrument, a glass capillary tube carrying the sample out of the iDEP chip is passed through two annular electrodes separated by a ground plane (FIG. 7A). One electrode provides a source AC signal, while the second detects the signal that is coupled through the capillary tubing and solution. The amplified output is then sent to the National Instruments cDAQ and is recorded by the LABVIEW®-based control program.

Figure 7B:
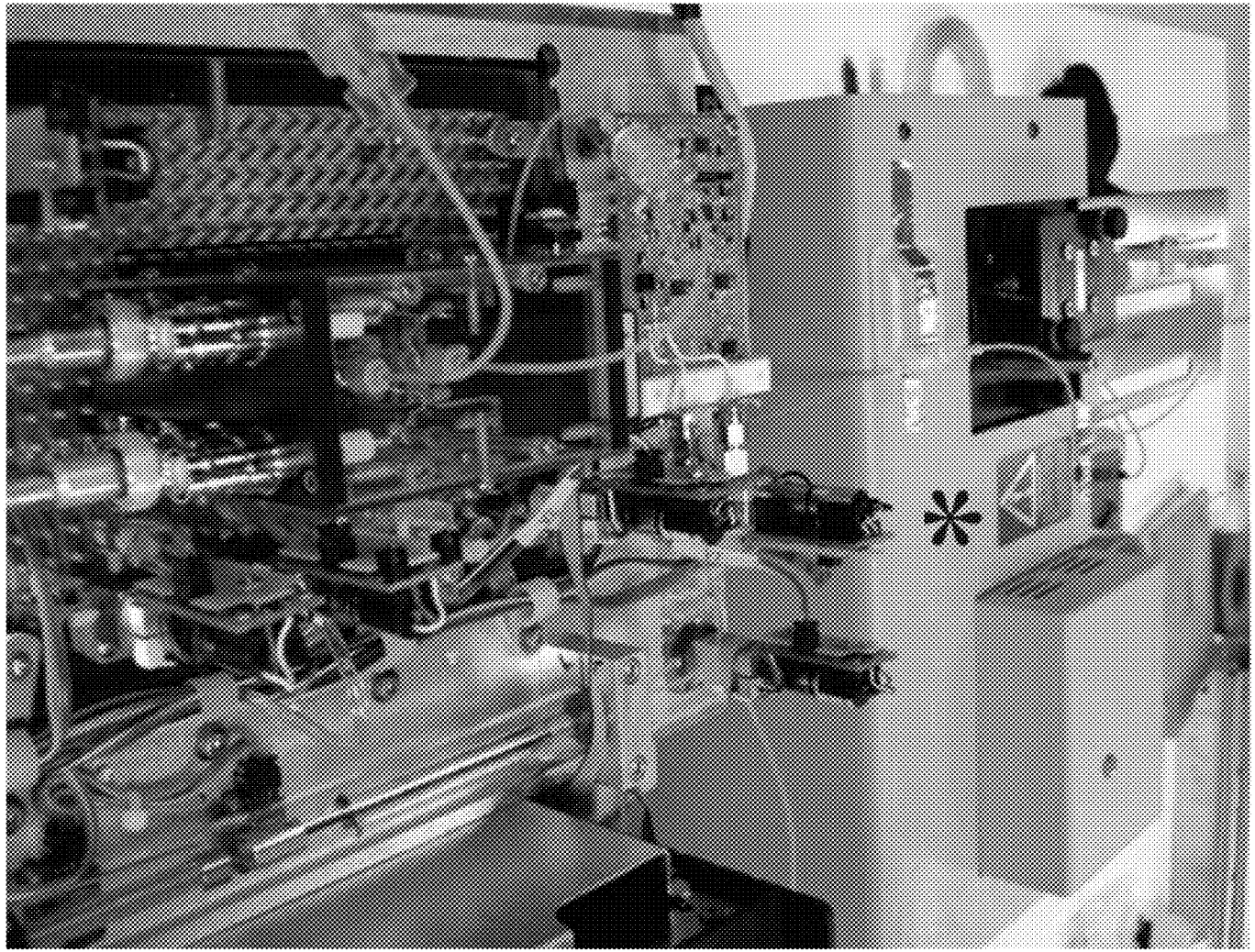
FIG. 7B shows the capillary based absorbance detector front panel and the right image shows the detector incorporated into the iDEP system.

Through-capillary absorbance spectrometer: A UV-visible light single wavelength spectrometer (Thermo Finnigan) was incorporated into the iDEP system and the fluorescence signal was recorded by the LABVIEW®-based control program (FIG. 7B). The spectrometer has an absorbance cell that sends monochromatic light through a glass capillary that carries the fluid out of the iDEP chip.

Figure 7D:
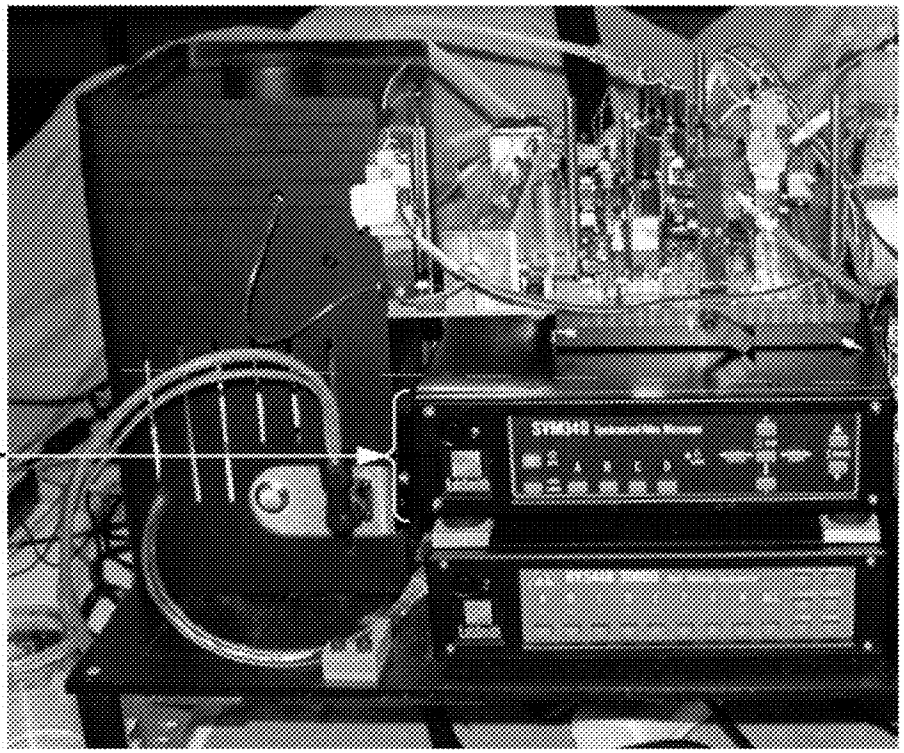
FIG. 7D shows the SVM340 microscope mounted below the iDEP chip holder and its associated microfluidic components.
Figure 7C:
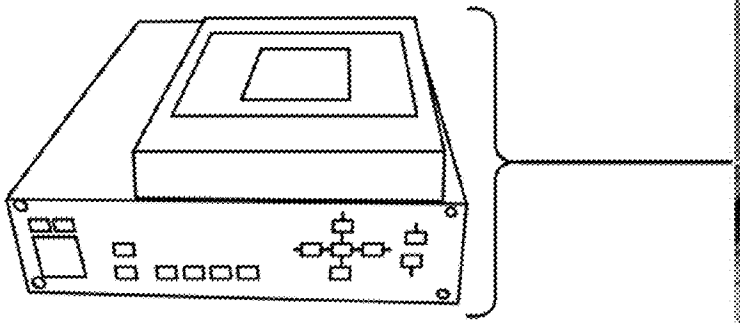
FIG. 7C shows the portable SVM340 microscope used for on-chip fluorescence spectrometry.

On-chip fluorescence spectrometry: An SVM340 portable microscope (LABSMITH™) shown in FIG. 7C, was incorporated into the lab-based iDEP system, shown in FIG. 7D, and used for routine recording of fluorescence images during trapping and to analyze the fluorescence images quantitatively. The fluorescence data was recorded by the control laptop as the trapping experiments were run.

Figure 7F:
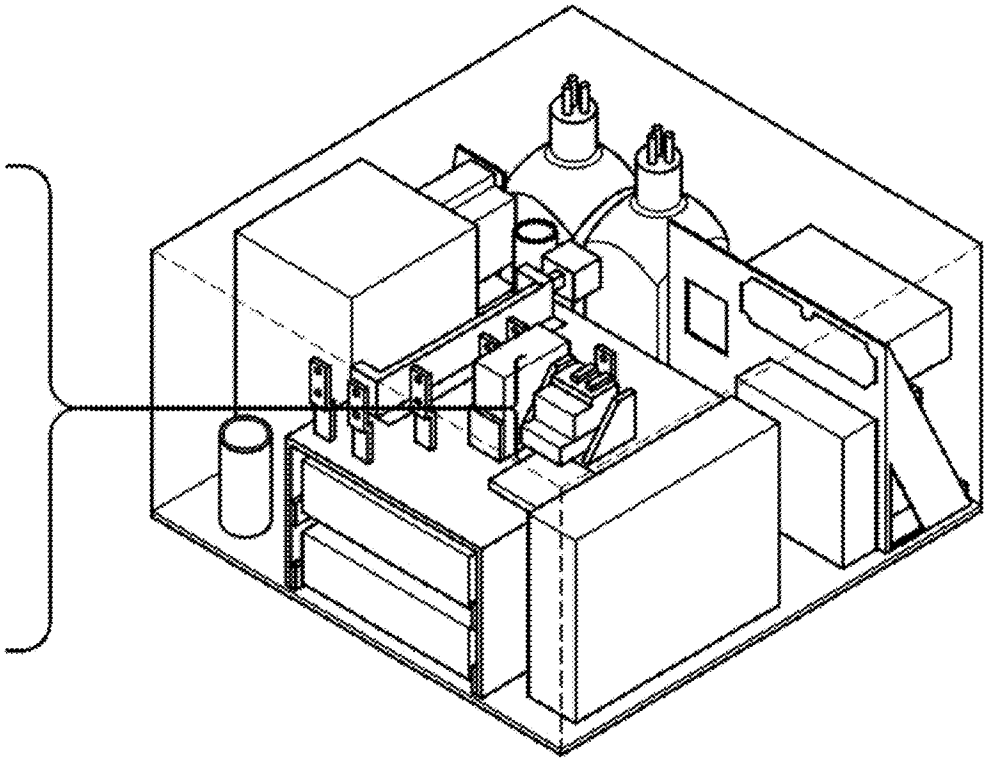
FIG. 7F illustrates a mock-up of the Field Test 1 iDEP unit utilizing a capillary-based LIF detector.
Figure 7E:
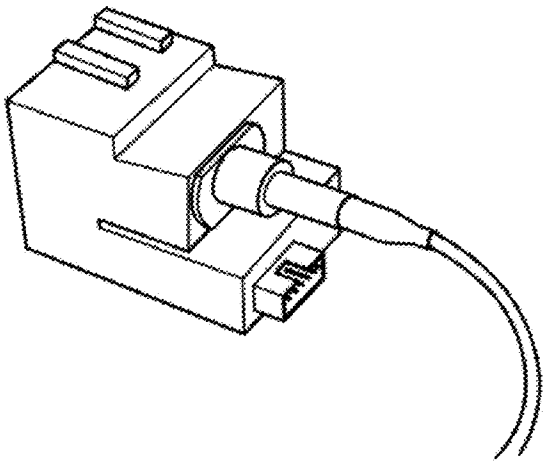
FIG. 7E illustrates a capillary-based LIF detector.

Off-chip, capillary-based based fluorescence spectrometer: A Sandia designed custom off-chip, modular, capillary-based laser induced fluorescence (LIF) spectrometer, such are disclosed in commonly owned U.S. Pat. Nos. 6,998,598 and 7,452,507, herein incorporated by reference, is shown in FIG. 7E and was incorporated into the system as shown in system mock-up, FIG. 7F. The modular concept provides for the use of a wide variety of components to fit particular needs. For example, almost any light source that can cause molecules to fluoresce, either naturally or tagged with a fluorophore, can be used in this system. Potential light sources that can be used in the optical detector system can include those that emit light from the infrared to the ultraviolet. These include, but are not limited to light-emitting diodes (LEDs), laser diodes, vertical cavity surface emitting lasers (VECSELs), vertical external cavity surface emitting lasers (VECSELs), dipole pumped solid state (DPSS) lasers or fiber optic connections that are subsequently coupled to light sources such as large laser systems, laser diodes or lamps. Moreover, optical system for detection means can include photomultiplier tubes, photodiodes, avalanche photodiodes or array detectors such as photodiode arrays and intensified charge-coupled devices (ICCD), or photosensitive detectors. These detection means can be run in analog signal collection mode, phase locked, or photon counting mode. LIF detectors have been used for many years both in the lab and in the field at various locations and have been developed to be miniature, rugged, and consume little power. These detectors have been used with a variety of excitation wavelengths to fluoresce biological pathogens.

Figure 8:
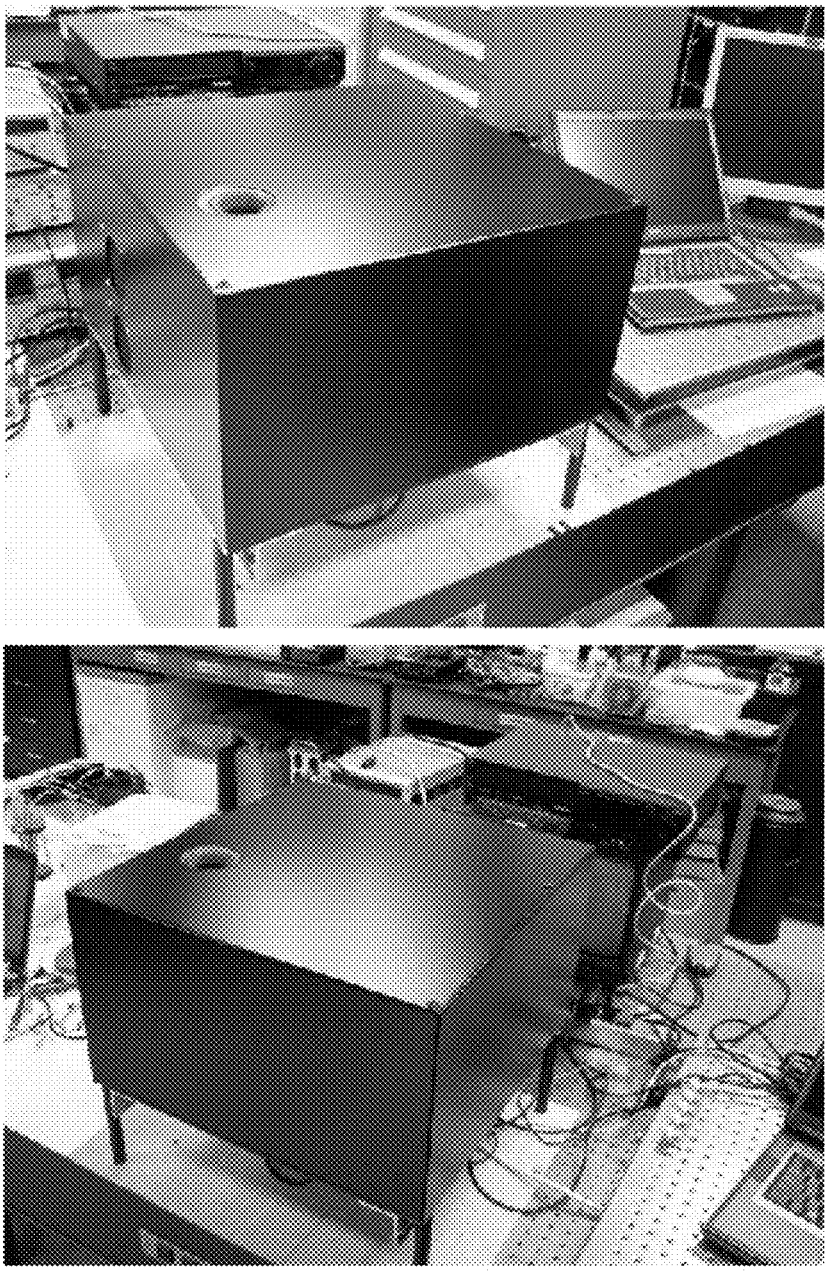
FIG. 8 shows two views of Field Test Unit 1 with the cover on. The opening on the top cover in both figures is the inlet to a commercially available aerosol sample collector, while the openings on the side of the unit are vents for the electronics.

Packaging:

The system was ruggedized for transport and final integration and testing at both the lab and at the public venue. Brackets were fabricated to secure all components firmly to the base plate. The entire system will fit in a compact 19.5"×20"×11" enclosure. The system requires one standard 120V 15 A outlet for power. The finished Field Test Unit 1 is shown in FIG. 8.

EXAMPLE

Figure 9A:
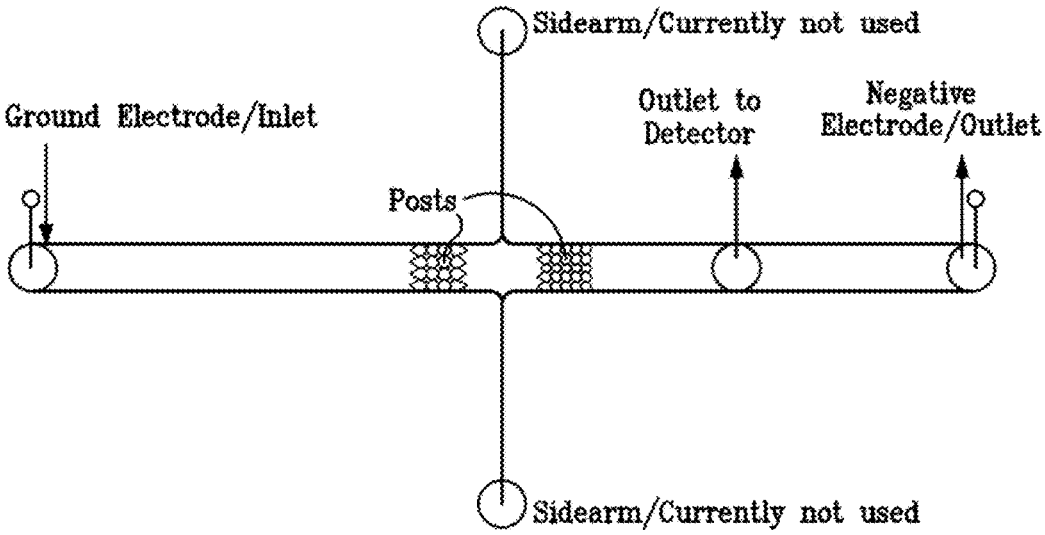
FIG. 9A shows a chip schematic, wherein sample is loaded into the chip by flowing in through the port labeled "Ground Electrode/Inlet" and flowing out through the port labeled "Negative Electrode/Outlet". During trapping and detection, the "Negative Electrode/Outlet" port is closed and energized and the sample flows out through the port labeled "Outlet to detector".
Figure 9B:
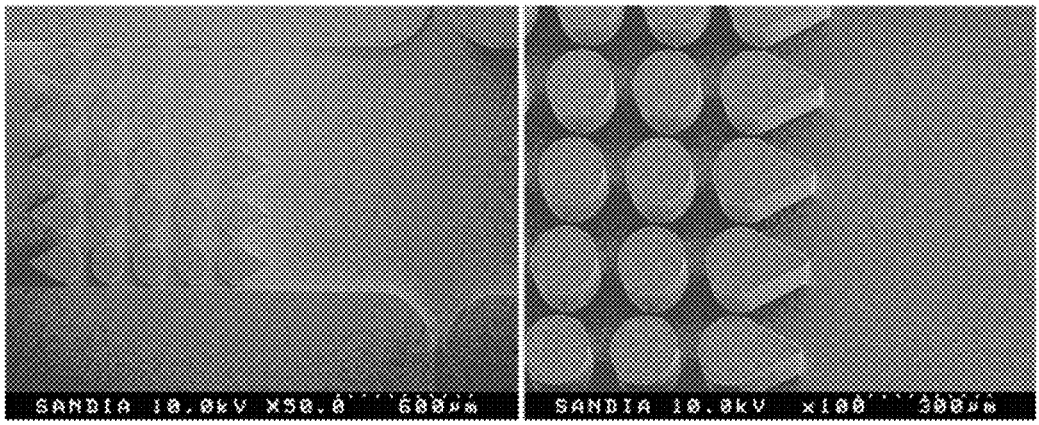
FIG. 9B shows a scanning electron microscope image of the plastic posts on the chip.

The iDEP chips, shown schematically in FIG. 9A, were manufactured by injection molding. Briefly, fabrication of polymer microfluidic devices involves the creation of a master etched in silicon or glass; plating of the master to produce a nickel stamp; large-lot replication of the microfluidic substrate by injection molding; and precision sealing of the substrate against a drilled ZEONOR™ plaque lid. The chips contain plastic posts in a 30 μm deep channel as shown as photomicrographs in FIG. 9B.

Figure 10A:
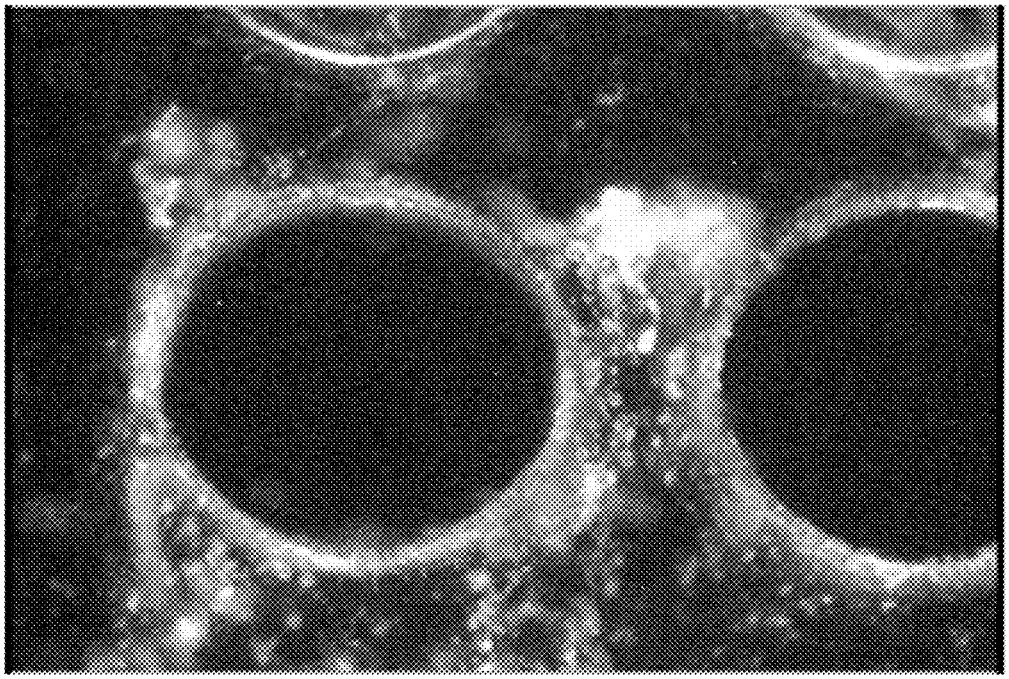
FIGS. 10A-10B illustrate that chips without MOPA treatment are much more susceptible to fouling (FIG. 10A) and are unable to trap particles (FIG. 10B).
Figure 10B:
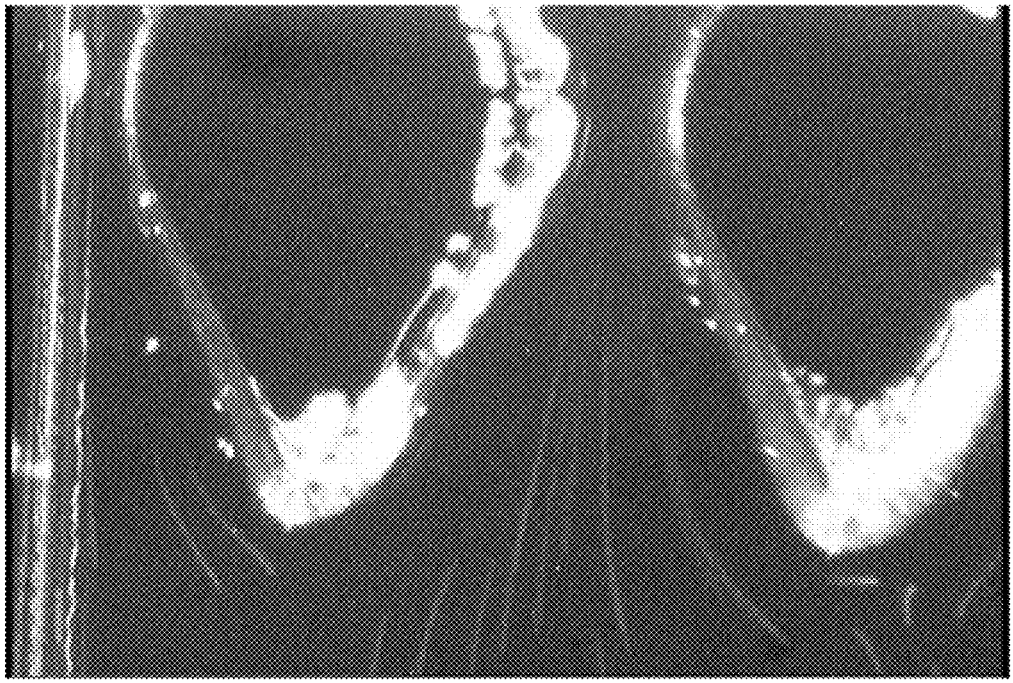

It was found that when first produced, the iDEP chips did not comprise a surface chemistry that would prevent or at least minimize particles from clogging and fouling the fluid channel as seen in FIG. 10A. It was also found that these chips were unable to trap particles as illustrated in FIG. 10B. The channel, therefore, did not provide for efficient particle trapping and it was necessary to treat the interior surfaces of the iDEP chip with an aqueous solution comprised of deionized water; 10 vol. % methoxy polyethylene glycol acrylate (MOPA) (obtained from the Sartomer Corporation as part number CD-551); 1 mM of sodium periodate ($NaIO_4$); and 0.5 vol. % benzyl alcohol ($C_6H_5CH_2OH$). The workpiece is immersed in the above solution and exposed to a source of 365 nm UV light for about 60 minutes. The source of UV light is again provided by a SPECTROLINKER™ XL 1500 operating at 365 nm (available from the Spectronics Corporation, Westbury, N.Y.). The MOPA treatment provides for hydroxyl functional groups attached to the surfaces of the chip and lowers the contact angle of the plastic substrate to 65°±4° versus 90°±2° without MOPA treatment.

It has also been necessary to adjust the pH of the background buffer to pH8 while simultaneously keeping its conductivity low. Trapping has been demonstrated with 0.001% TWEEN® 20 (a polyoxyethylene derivative of sorbitan monolaurate obtained from the Promega Corporation, Madison, Wis.). Other TWEEN compositions may be possible but were not attempted. It would be expected that a different surfactant concentration would be needed if other TWEEN compositions were used. It is important to demonstrate trapping in the presence of TWEEN® 20 as this is the additive present in the water used by the aerosol sample collector. TWEEN® 20 prevents fouling of the aerosol sample collector components and increases the collection efficiency of the aerosol sample collector. In addition, TWEEN® 20 containing water solutions are used to flush out and clean the iDEP chips between runs.

The inlet and outlet electrodes, shown in FIG. 9A, each comprised a 1.25 inch long, 1 mm O.D., 0.75 mm I.D., AISI Type 316 austenitic stainless steel tube. The cross-section of these electrodes was large when compared to the cross-section of the capillary tubing used throughout most of the remainder of the iDEP system.

Figure 12A:
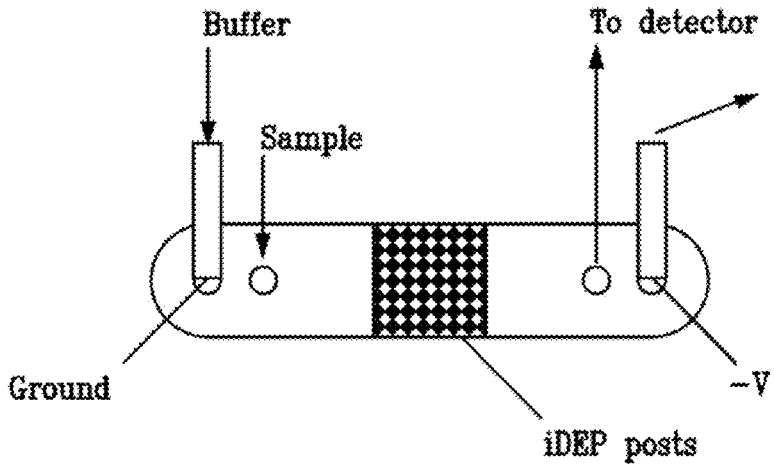
FIG. 12A shows the initial intended fluidic configuration for iDEP chips, wherein the buffer was injected into the ground inlet electrode-port while the sample was injected through the non-energized inlet port. Part of the fluid flow was extracted through the non-energized outlet port and would be routed through the off-chip detector while the bulk of the fluid flow came out of the negatively biased outlet electrode-port and went to the waste bottle.
Figure 12B:
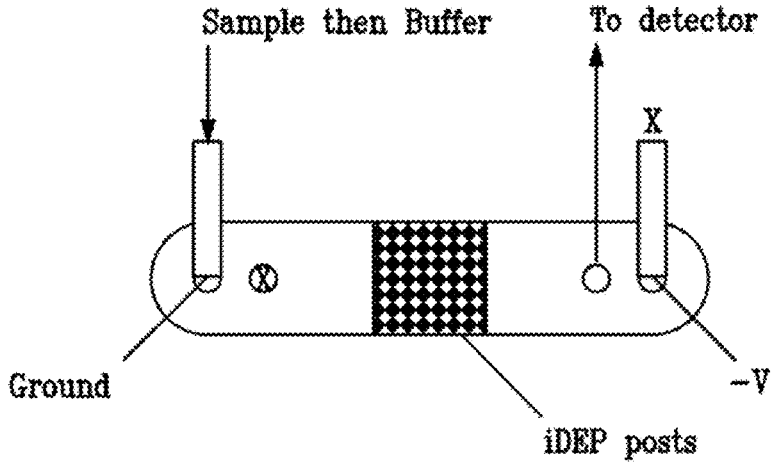
FIG. 12B shows a second configuration wherein some trapping was achieved by first injecting the sample and then the buffer through the ground inlet electrode-port and flowing all of the fluid out through the non-energized outlet port. (X's indicate ports that are closed off to fluid flow).
Figure 12C:
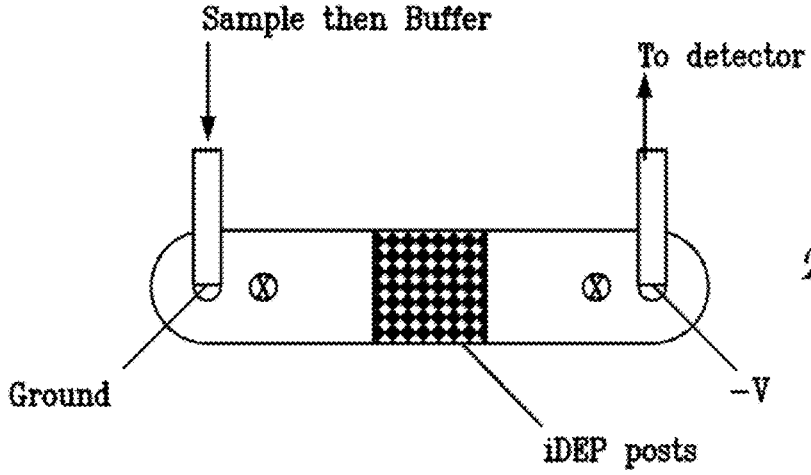
FIG. 12C shows a third configuration, wherein reliable trapping and off-chip detection were achieved by first injecting the sample and then the buffer through the ground inlet electrode-port and flowing all of the fluid out through a reduced volume negatively biased outlet electrode-port and then routing that fluid through the detector.
Figure 11:
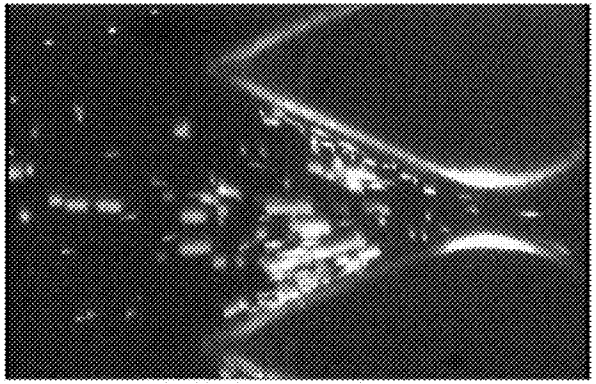
FIG. 11 illustrates a chip treated with MOPA trapping particles in a flow stream.

The optimal way to introduce the sample into the iDEP chip was empirically determined as shown in FIGS. 12A-12C. The initial approach, shown in FIG. 12A, called for injecting the buffer at 1 to 10 μL/minute into the ground inlet electrode-port while the sample was injected at 1 to 3 microliters per minute through the non-energized inlet port. Part of the fluid flow was extracted through the non-energized outlet port and was routed through the off-chip detector while the bulk of the fluid flow came out of the negatively biased outlet electrode-port and went to the waste bottle. No trapping was seen with this approach.

After further experimentation and modifications to the fluidic architecture, some trapping was achieved by first injecting the sample (50 μL/minute, 200 μL total volume) and then the buffer (3 tit/minute) through the ground inlet electrode-port and flowing all of the fluid out through the non-energized outlet port (see FIG. 12B).

In the final, successful configuration (see FIG. 12C) both reliable trapping and off-chip detection were finally achieved by first injecting the sample and then the buffer through the ground inlet electrode-port and flowing all of the fluid out through a reduced volume negatively biased outlet electrode-port and routing that fluid through the detector. The reduced volume negatively biased electrode was necessary because the original outlet electrode was too large and fluid took about an hour to flow out and into the detector. The reduced volume outlet electrode was constructed from a one inch long, 360 μm O.D., 175 μm I.D., AISI Type 316 stainless steel capillary tubing section. The cross-section of this electrode was thus the same as the cross-section of the capillaries used throughout the system and the delay in fluid flow out of the chip was vastly minimized.

Trapping and Detection:

When in use, the background buffer (also pH8 DI water with 0.001% TWEEN® v/v) was flowed through the inlet electrode and through the rest of the system for about a minute at 3 μL/minute using a stepper motor, microprocessor-controlled pump such as a MILLIGAT® pump (available from Global FIA, Inc. Fox Island, Wash., USA) comprising a miniature pump/motor/gear assembly, a micro-electric controller, and a linear power supply. In order to begin trapping particles, a portion of the fluid sample generated by the aerosol collector is introduced into the fluid stream and thus into the fluid pump where it is directed into the iDEP chip. The voltage at the inlet electrode of the iDEP chip is initially set to Ground (done to avoid the leakage of voltage upstream to the metal MILLIGAT® pump) and the outlet electrode set to a predetermined negative potential, e.g., ~−1600 V. The range of voltage potentials necessary to trap any specific particle species, e.g., pathogenic spores or bacteria, would need to be determined experimentally since, presumably, the optimal trapping potential for each would be different. Initially, the system would be set up to investigate voltage ranges which were most effective at trapping particles of interest, e.g., pathogens and the like. In actual use, therefore, the device potentials would be preset to scan specific ranges of voltage in an either ascending or descending protocol and thereby incrementally step through the range of voltages found to be important for diagnostic inspection. At each level, the voltages are held constant at the pre-set values for 30 seconds in order to achieve particle trapping within the system, assuming that particles having the targeted trapping characteristics are present within the sample. After the 30 seconds, the trapping phase was completed and the voltages of both the inlet and outlet electrodes were set to Ground and the cycle begun again at an incremented potential.

Figure 13C:
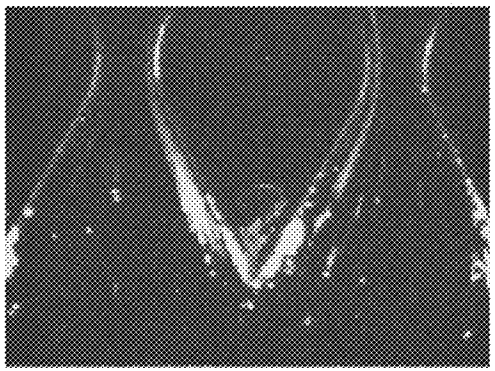
FIGS. 13A-13C show a series of fluorescence snapshots from a typical trapping experiment.
Figure 13B:
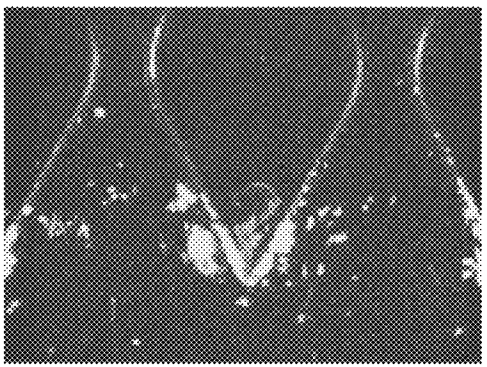
Figure 13A:
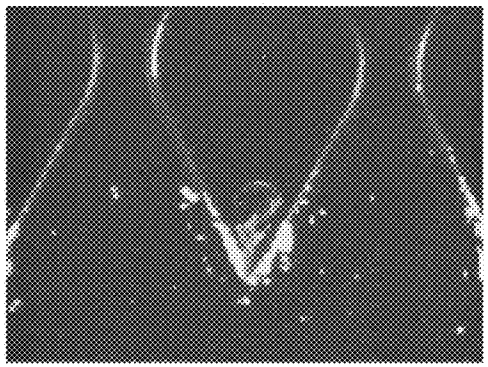

In a typical trapping experiment 200 microliters of beads or of *Bacillius globigii* (Bg) spores ($10^6$ particles/ml suspended in pH8 deionized (DI) water with 0.001% TWEEN® v/v) labeled with fluorescein isothiocyanate (FITC) were injected into the inlet electrode before any voltage was applied. FIGS. 13A-13C show a series of fluorescence snapshots of video recorded through the fluorescence microscope during a typical trapping experiment. For 2 μm diameter polymer beads flowing at 3 μL/minute, the trapping started at about −1000 volts and was completed at −1600 volts. Trapping could be repeated five to ten times with a given chip before the chip had to be pressure-washed with background buffer.

Finally, in order to automate the detection and allow for unattended operation in the field, four detector technologies were evaluated.

Figure 14A:
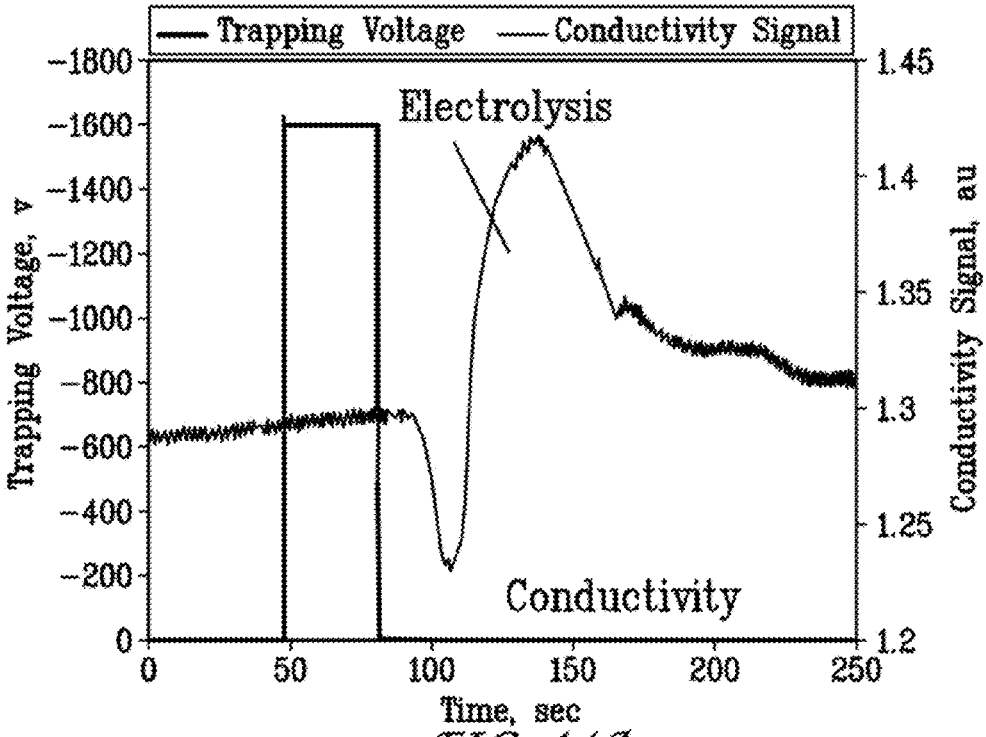
FIG. 14A shows the effects of electrolysis generated artifacts on an impedance detector.
Figure 14B:
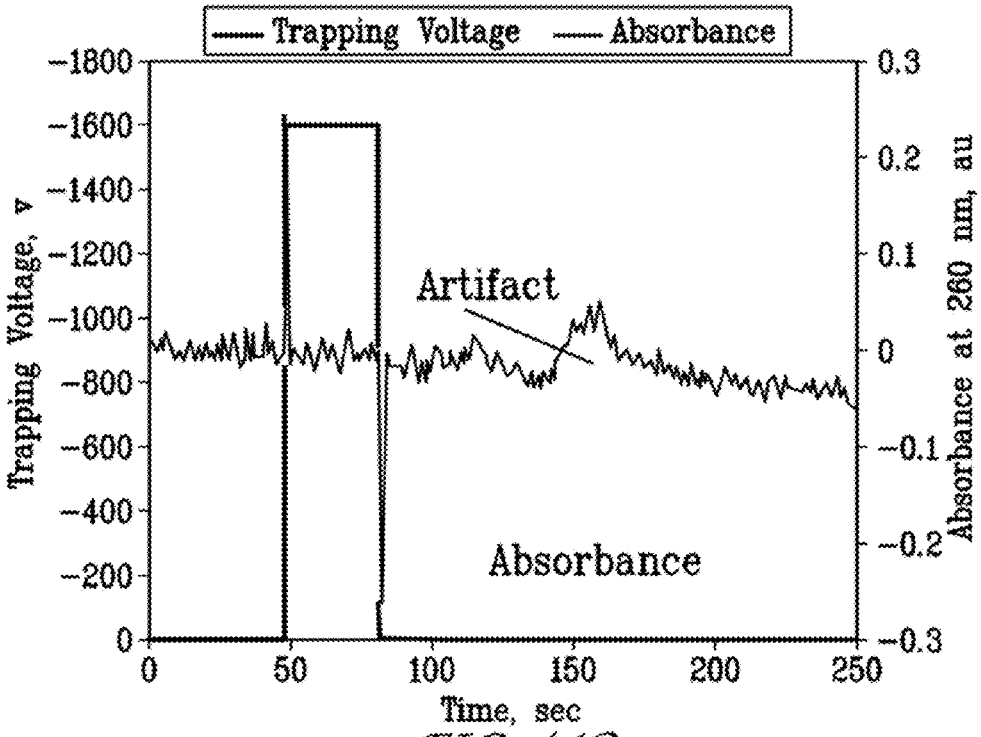
FIG. 14B shows the effects of electrolysis generated artifacts on a absorbance detector.

In doing so, it was discovered that off-chip, capillary-based impedance and absorbance detectors were affected by iDEP-trapping related artifacts (FIGS. 14A and 14B). We hypothesize that a large amount of ions are produced via electrolysis when the large trapping voltages are applied and these ions give large impedance and absorbance signals that completely mask the presence of trapped particles.

Figure 15A:
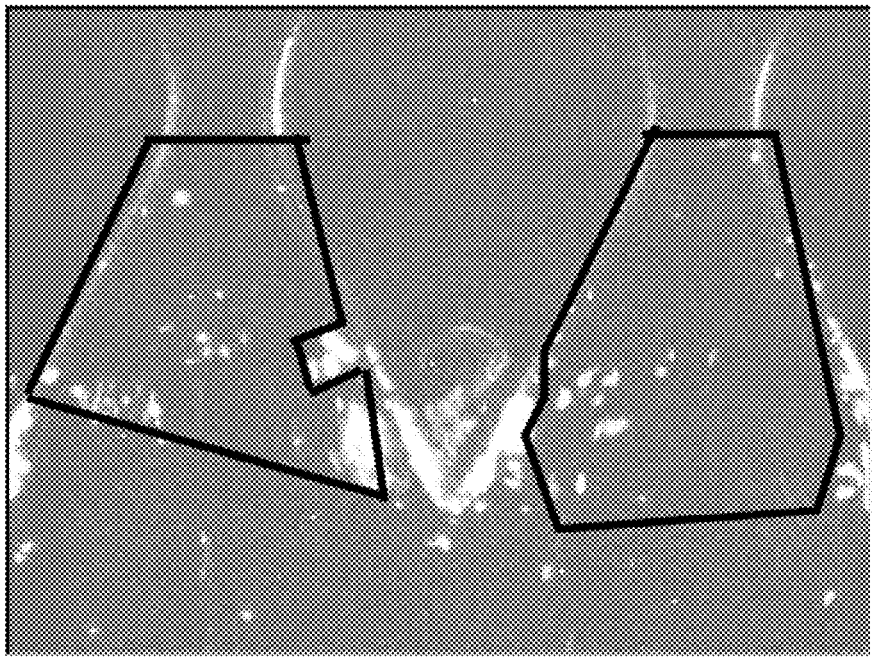
FIG. 15A shows areas programmed into the SVM340 microscope for fluorescence analysis.
Figure 15B:
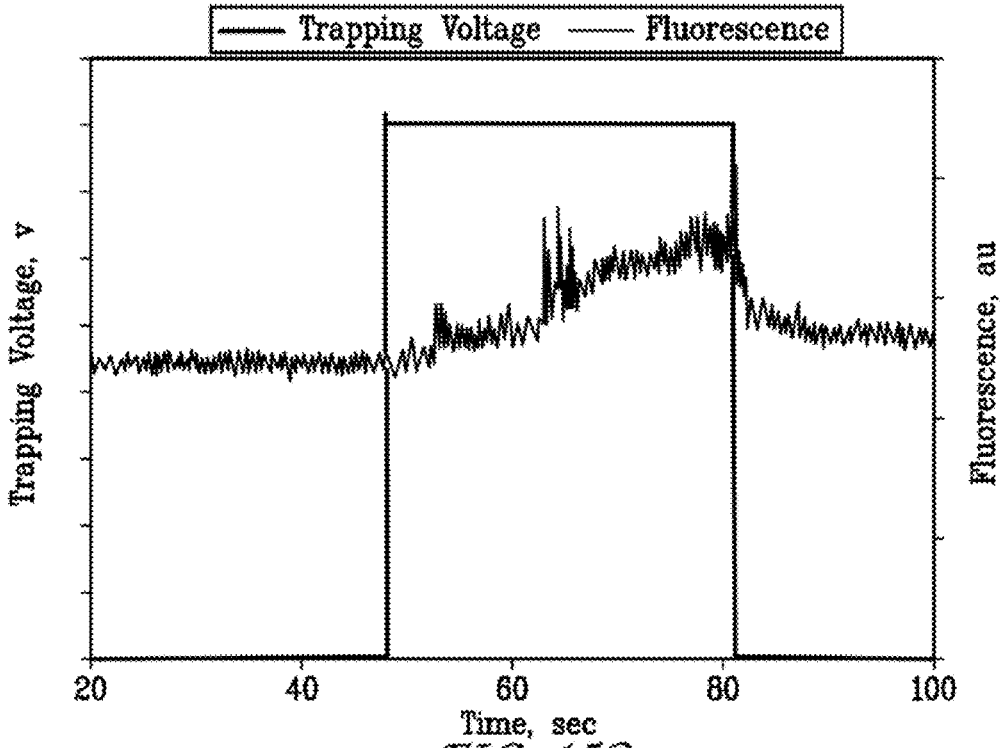
FIG. 15B shows the fluorescence signal obtained from areas shown in FIG. 15A during the experiment shown in FIGS. 13A-13C.

An inverted fluorescence video microscope (a SVM340 microscope available from LABSMITH™, Inc., Livermore, Calif.) was used to analyze the fluorescence signal during and after experiments. The microscope software allows the user to optimize the signal to noise ratio of the fluorescence intensity analysis by drawing analysis areas on the computer microscope viewer. Only the fluorescence data in those areas are integrated over time. FIGS. 15A and 15B show the analysis areas and the fluorescence signal as a function of time for the trapped particles shown in FIGS. 13A-13C.

The SVM340 based on chip fluorescence detection was not affected by iDEP artifacts. This technique senses the trapping and concentration of particles between the posts. Since the particles are trapped between the posts as soon as the voltage is turned on, the detector responds within seconds of turning on the trapping voltage. Unfortunately, the optics of the SVM340 detector are not sufficiently robust to interrogate the chip for particles that did not carry a fluorescent tag; and while it is possible, in principle, to detect biological particles using native fluorescence, such an approach would require a modifying the chip and chip holder to include a fiber optic conduit for directing the needed excitation light and for returning the excited fluorescent signal from the particles trapped within the chip, and to provide for optical transparency above or below the chip's trapping region. This latter condition would likely require the chip and/or chip cover to be fabricated from fused silica or quartz.

Figure 16A:
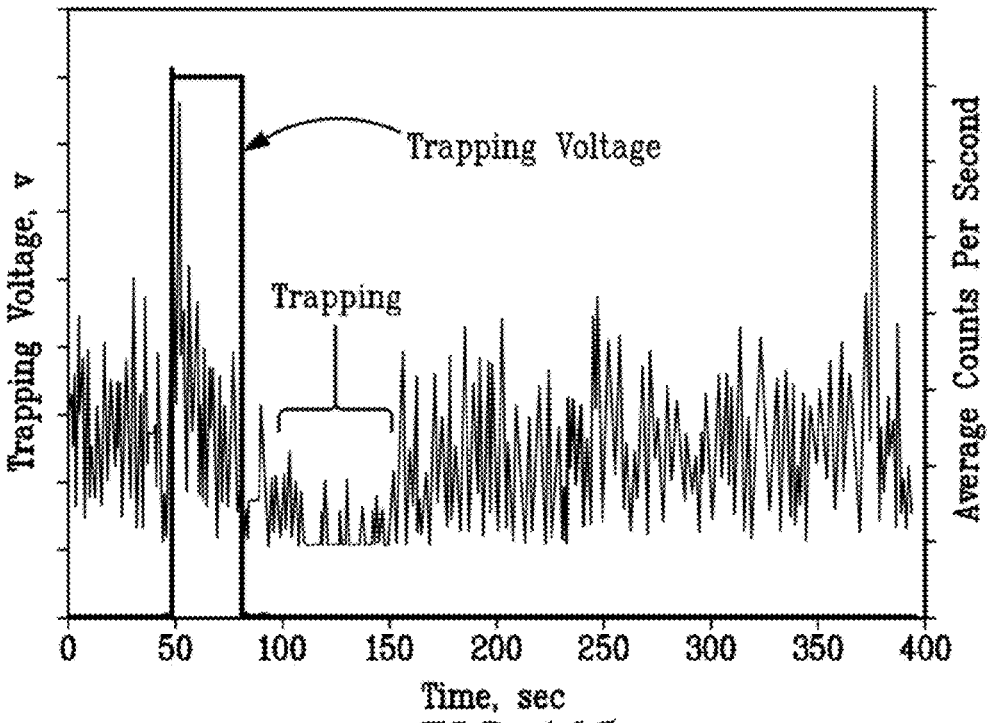
FIG. 16A illustrates data collected with Field Test Unit 1 while deionized (DI) water containing fluorescently labeled polymer beads with an average concentration of $10^6$ microbeads/ml is flowing through the iDEP chip.
Figure 16B:
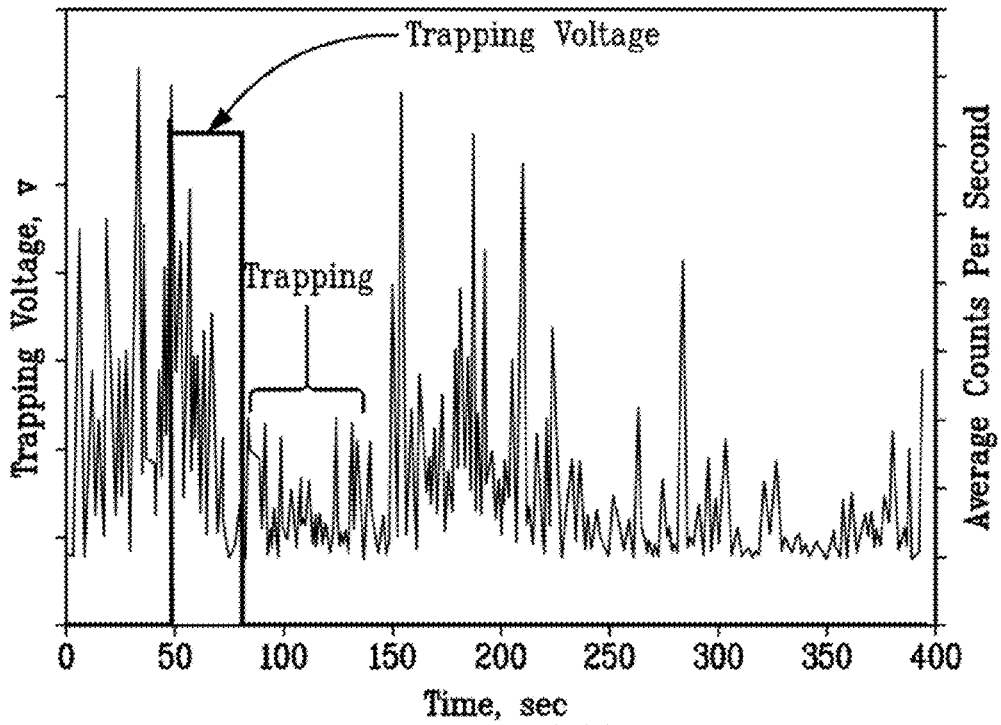
FIG. 16B illustrates data collected with Field Test Unit 1 while DI water containing fluorescently labeled *Bacillus globigii* (Bg) having an average concentration of $10^6$ particles/ml flows through the iDEP chip.

While the three foregoing detection techniques could not be adapted to provide unattended operation the system was successfully operated using an off-chip laser induced fluorescence technique. FIGS. 16A and 16B show data collected during trapping and release of beads and Bg spores using the Sandia off-chip LIF detector. In this method, no redesign of the chip or chip holder was necessary to detect particles at various wavelengths. The technique operates as follows. As fluid is pumped through the system it continues through the iDEP chip and is then redirected through a capillary off-chip and directed through a transparent capillary in the LIF instrument where suspended particles are illuminated by the LIF light source. The entrained particles are excited by the light source and emit a fluorescent signal (either the result of native fluorescence or due to an attached fluorescent tag) that can be detected by a photometer/photomultiplier tube (PMT) contained within the LIF. This detected signal forms a background baseline signal.

It will be appreciated that as soon as the trapping voltage is turned on, the fluorescence signal at the off-chip detector first instantaneously increases before beginning to rapidly decrease. We hypothesize that the first response is due to the electrokinetic forces accelerating the particles near the detector due to the applied electric field and the second response is an indication of containment initiation of a majority of the particles contained in the fluid up-stream in the iDEP chip. Trapping, therefore, is confirmed about a minute after the voltage to the electrodes in the iDEP chip is turned ON by a decrease in detected signal below an average background baseline level of the fluorescence signal count. The one minute delay in response is presumed to be caused by the time taken for the fluid to travel from the trapping region on the iDEP chip to the LIF sensor located about 2 inches away from the chip. That is, after the trapping voltage is turned ON, particles are immobilized within the post region of the iDEP chip while the fluid formerly containing the trapped particles, continues moving eventually leading to a particle depleted region of fluid reaching the detector. A minute after the trapping voltage is turned OFF, particles are once again detected as the fluorescence signal returns its average base-line count rate detected before trapping.

Lastly, we found that the off-chip LIF detector was not capable of detecting an iDEP induced increase in the concentration of particles. It was only capable of detecting the trapping and the release of the particles. This is due mainly because as the concentrated particles are released, they travel from the restricted fluid volume between the posts having a total cross-section of about 6,000 $\mu m^2$ to the open channel having cross-section of about 5× as great and then into the 150 μm diameter capillary having a cross-section of 17,670 $\mu m^2$. Furthermore, the Peclet number in the capillary decreases by a factor of 3 and so diffusive mixing is increased downstream as the particles travel approximately 60 millimeters (~2¼ inches) to the off-chip fluorescence detector.

The iDEP system has been run repeatedly in the lab. iDEP chips can be reused 5 to 10 times before fouling after which a simple high flow background buffer injection is used to clean and reset the chip. The packaging and assorted electronic and mechanical components that make up the system are robust and reliable. As currently configured the iDEP system can be operated for up to eight hours unattended before needing to be serviced.

Having thus described an exemplary embodiment of the present invention, it should be noted by those skilled in the art that the disclosures herein are exemplary only and that various other alternatives, adaptations, and modifications may be made within the scope of the present invention. Accordingly, the present invention is not limited to the specific embodiments as illustrated herein, but is only limited by the following claims.

Finally, to the extent necessary to understand or complete the disclosure of the present invention, all publications, patents, and patent applications mentioned herein are expressly incorporated by reference therein to the same extent as though each were individually so incorporated.

What is claimed is:

1. A system for concentrating and detecting particles contained in a surrounding atmosphere, comprising:

an insulator-based dielectrophoretic (iDEP) microfluidic chip comprising a fluid channel;

a channel cover bonded to a top surface of the fluid channel;

an inlet and an outlet port disposed at opposite ends of the channel and a concentration region disposed therebetween comprising a plurality of insulating posts; and a tube electrode is disposed in each of the inlet and the outlet ports, a first tube electrode in the outlet port comprising a reduced cross section relative to a second tube electrode in the inlet port;

at least one programmable high voltage power supply in electrical communication with each of the electrodes;

an aerosol collector comprising a fluid sample configured to collect aerosolized particles;

one or more fluid pumps;

one or more fluid reservoirs in fluid communication with the one or more fluid pumps;

a plurality of fluid conduits, valves and valve fittings interconnecting the aerosol collector with the one or more fluid pumps and with the iDEP microfluidic chip (iDEP chip), wherein each of the plurality of fluid conduits, fluidic valves and valve fittings, the aerosol collector, the one or more fluid pumps and one or more fluid reservoirs and the iDEP chip are all in fluidic communication with each other, wherein the fluid sample is passed from the aerosol collector and into the iDEP chip inlet port;

a particle detector comprising a laser light source and a light detection means optically coupled to the iDEP chip or to a transparent fluid conduit exiting the iDEP chip outlet port, the particle detector configured to direct excitation light at a first wavelength into the fluid sample and receive fluorescence light emitted at a second wavelength by particles entrained within the fluid sample, the particle detector further configured to generate an electrical analog output signal proportional to the intensity of the received emitted light; and a programmable data acquisition recorder (DAQ) in electronic communication with the one or more fluid pumps, the plurality of fluidic valves, the at least one programmable power supply and the particle detector, wherein the DAQ is programmed to perform digital and analog input and output functions including controlling and monitoring the operation and status of each of the plurality of fluidic valves, to control and monitor the operation and status of the one or more fluid pumps, to control the laser light source, and to acquire signal information received by the particle detector, generate a running average baseline value of the running recorded signals received from the particle detector and signaling an alert if the running average signal changes beyond a preset threshold.

2. The system of claim 1, wherein the channel and cover are comprised of a thermoset plastic, fused silica, or fused quartz.

3. The system of claim 2, wherein the channel and cover further comprised modified interior surfaces.

4. The system of claim 3, wherein the modified interior surfaces comprise a plurality of hydroxyl functional groups.

5. The system of claim 3, where in the interior surfaces have been modified by the addition of a plurality of hydrophilic functional groups.

6. The system of claim 5, wherein the hydrophilic functional groups comprise hydroxyl functional groups.

7. The system of claim 6, wherein the plurality of hydroxyl functional groups are provided by exposing the interior surfaces to a solution comprised of a dilute aqueous solution of water, methoxyl polyethylene glycol acrylate, sodium periodate ($NaIO_4$), and benzyl alcohol ($C_6H_5CH_2OH$) following by irradiating the interior surfaces with a source of UV light.

8. The system of claim 1, wherein the aerosol collector is limited to collecting respirable-sized particles that might lodge in the human lungs.

9. The system of claim 8, wherein the aerosol collector is limited to collecting particles greater than about 0.5 μm and smaller than about 10 μm.

10. The system of claim 1, wherein the one or more fluid pumps comprise at least one syringe-type pump and at least one microprocessor controlled stepper motor fluid pump.

11. The system of claim 1, wherein the plurality of insulating posts are arranged in an array.

12. The system of claim 11, wherein the array is an ordered array.

13. The system of claim 1, wherein the plurality of insulating posts each have a shape, and wherein the shape of each post is the same or is different.

14. The system of claim 1, wherein the one or more fluid reservoirs include a buffer fluid having a pH adjusted for pH8.

15. The system of claim 1, wherein the one or more fluid reservoirs include a buffer fluid having a pH adjusted for pH8.

16. The system of claim 15, wherein the one or more buffer fluid further includes a compound comprising a polyoxyethylene derivative of sorbitan monolaurate.

17. The system of claim 1, wherein the light source is selected from the list consisting of light-emitting diodes, laser diodes, vertical cavity surface emitting lasers, vertical external cavity surface emitting lasers, dipole pumped solid state lasers, and combination of optical fibers and lasers systems, laser diodes or lamps.

18. The system of claim 1, wherein the light detection means is selected from the list consisting of photomultiplier tubes, photodiodes, avalanche photodiodes, photodiode arrays, charged-couples devices, and intensified charged-coupled devices.

19. The system of claim 1, wherein the light source further includes an optical fiber.

20. The system of claim 1, wherein the light detection means further includes an optical fiber.

21. A method for initiating a signal response in a system for detecting the presence of particles contained in a surrounding atmosphere, comprising the steps of:

collecting a representative sample of air surrounding the system and forming a fluid suspension comprising a carrier liquid and any particles contained in the representative sample of air;

pumping the fluid suspension into and through a capillary connected in fluid communication with a microfluidic insulative dielectrophoresis (iDEP) chip, wherein the iDEP chip comprises an inlet and an outlet port, a first tube electrode disposed in the inlet port and a second tube electrode disposed in the outlet port, the second tube electrode comprising a reduced cross section relative to the first tube electrode, and wherein the fluid suspension enters the iDEP chip through the inlet port and exits through the outlet port and continues through a transparent capillary and empties into a waste reservoir;

applying a range of electrical potentials between the first and second electrodes, wherein the range of electrical potential is chosen to create a dielectrophoretic field within an interior volume of the iDEP chip sufficient to immobilized particles contained within the fluid suspension and thereby temporarily trapping the particles in the interior volume of the iDEP chip but allowing the carrier liquid to pass through the iDEP chip and transparent capillary and into the waste reservoir;

directing an intense source of light into the transparent capillary and monitoring the fluid suspension contained therein and detecting and recording a fluorescence response signal, wherein the amplitude of the detected response signal comprises a qualitative indication of the relative concentration of particles within the carrier liquid;

generating a running average baseline value of the recorded response signal amplitude; and signaling an alert if, shortly after applying the electrical potential, the running average baseline value falls below a preset threshold limit as an indication of particle-trapping within the iDEP chip.

22. The method of claim 21, wherein the step of collecting further comprises a carrier liquid comprising water and a surfactant.

23. The method of claim 21, wherein the step of directing an intense source of light further comprises a source of light selected from the list consisting of light-emitting diodes, laser diodes, vertical cavity surface emitting lasers, vertical external cavity surface emitting lasers, dipole pumped solid state lasers, and combination of optical fibers and lasers systems, laser diodes or lamps.

24. The method of claim 23, wherein the step of directing an intense source of light further includes an optical fiber.

25. The method of claim 21, wherein the step of detecting and recording comprises any of one or more photomultiplier tubes, photodiodes, avalanche photodiodes, photodiode arrays, charged-couples devices, and intensified charged-coupled devices, or combinations thereof.

26. The method of claim 25, wherein detecting and recording further includes an optical fiber.

27. The method of claim 21, wherein the step of signaling an alert comprises any or all of generating a visual alarm, generating an audible alarm, generating a text log, and/or initiating an automated response.

28. The method of claim 27, wherein the step of signaling an alert comprises the step of initiating an automated response.

29. The method of claim 28, wherein the automated response comprises conducting an bio-analysis of the particles contained with in the carrier liquid.

* * * * *